US011382416B2

(12) United States Patent
Choi et al.

(10) Patent No.: US 11,382,416 B2
(45) Date of Patent: Jul. 12, 2022

(54) STRESS-DISPERSING STRUCTURE, FRAME AND TABLE HAVING SAME

(71) Applicant: Inno-Sports Co., Ltd., Xiamen (CN)

(72) Inventors: Kwan Jun Choi, Xiamen (CN); Renhua Chen, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 16/951,461

(22) Filed: Nov. 18, 2020

(65) Prior Publication Data

US 2021/0169214 A1 Jun. 10, 2021

(30) Foreign Application Priority Data

Dec. 9, 2019 (CN) ..... 201922188730.X
Apr. 8, 2020 (CN) ..... 202020502707.3

(51) Int. Cl.

| | |
|---|---|
| ***A47B 3/087*** | (2006.01) |
| ***A47B 3/091*** | (2006.01) |
| ***A47C 11/00*** | (2006.01) |
| ***A47B 3/14*** | (2006.01) |
| *A47B 3/083* | (2006.01) |

(52) U.S. Cl.

CPC ..... *A47B 3/087* (2013.01); *A47B 3/0912* (2013.01); *A47B 3/14* (2013.01); *A47C 11/00* (2013.01); *A47B 2003/0835* (2013.01)

(58) Field of Classification Search

CPC ..... A47B 3/14; A47B 3/87; A47B 3/0912; A47B 2003/145; A47B 2003/0835; A47C 11/00

USPC ..... 297/158.4

See application file for complete search history.

(56) References Cited

U.S. PATENT DOCUMENTS

| | | | |
|---|---|---|---|
| 1,063,642 | A | 6/1913 | Birdsell |
| 2,136,569 | A | 11/1938 | Trimpi |
| 2,803,033 | A | 8/1957 | Rachman |
| 2,803,050 | A | 8/1957 | Birger Fernberg |
| 2,868,599 | A | 1/1959 | Roggio |
| 3,075,809 | A | 1/1963 | Wilson |

(Continued)

FOREIGN PATENT DOCUMENTS

| | | | |
|---|---|---|---|
| CA | 2971886 | A1 | 12/2018 |
| DE | 29515948 | U1 | 1/1996 |

(Continued)

*Primary Examiner* — Jose V Chen

(74) *Attorney, Agent, or Firm* — Morgan, Lewis & Bockius LLP

(57) ABSTRACT

A foldable table includes a tabletop, first and second table leg assemblies, and first and second supporting assemblies. Each of the first and second table leg assemblies is pivotally coupled with the tabletop and rotatable with respect to the tabletop between a use position and a storage position. The first supporting assembly is pivotally coupled with the tabletop and first table leg assembly, and the second supporting assembly is pivotally coupled with the tabletop and second table leg assembly. Each of the first and second supporting assemblies includes first and second supporting members slidably and rotatably coupled with each other such that sliding and rotating movement between the first and second supporting members of a respective supporting assembly allows a corresponding table leg assembly to rotate with respect to the tabletop between the use and storage positions.

20 Claims, 24 Drawing Sheets

(56) References Cited

U.S. PATENT DOCUMENTS

| | | | | |
|---|---|---|---|---|
| 3,187,373 | A | 6/1965 | Fisher | |
| 3,276,815 | A | 10/1966 | Ernest | |
| 3,368,504 | A | 2/1968 | Cohen | |
| 3,410,232 | A | 11/1968 | Bills | |
| 3,410,327 | A | 11/1968 | Ausnit | |
| 3,574,393 | A | 4/1971 | Hughes | |
| 3,861,328 | A | 1/1975 | Lawless | |
| 4,191,111 | A | 3/1980 | Emmert | |
| 4,285,105 | A | 8/1981 | Kirkpatrick | |
| 4,561,108 | A | 12/1985 | Kamp | |
| 4,792,240 | A | 12/1988 | Ausnit | |
| 5,325,794 | A | 7/1994 | Hontani | |
| 5,483,710 | A | 1/1996 | Chan | |
| 5,745,954 | A | 5/1998 | Shogan | |
| 5,857,229 | A | 1/1999 | Magnani, Jr. | |
| 5,921,623 | A * | 7/1999 | Nye | A47B 3/14 297/158.4 |
| 6,223,366 | B1 | 5/2001 | Cheng | |
| 6,347,831 | B1 * | 2/2002 | Nye | A47B 3/14 297/118 |
| 6,363,550 | B1 | 4/2002 | Wang | |
| 6,508,262 | B1 | 1/2003 | Takayama | |
| 6,644,734 | B1 * | 11/2003 | Tseng | A47B 3/14 297/158.4 |
| 6,843,183 | B2 | 1/2005 | Strong | |
| 6,971,321 | B1 | 12/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,260,871 | B2 | 8/2007 | Borchardt | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,113,130 | B2 | 2/2012 | Leng | |
| 8,132,517 | B2 | 3/2012 | Leng | |
| 8,156,875 | B2 | 4/2012 | Neunzert et al. | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 8,904,943 | B2 | 12/2014 | Jin | |
| 9,027,952 | B2 | 5/2015 | Zhu | |
| 9,103,368 | B2 | 8/2015 | Mendes | |
| D748,418 | S | 2/2016 | Johnson et al. | |
| 9,277,808 | B2 | 3/2016 | Cai et al. | |
| 9,282,812 | B2 | 3/2016 | Chang | |
| D756,694 | S | 5/2016 | Johnson et al. | |
| 9,351,563 | B2 | 5/2016 | Bennett et al. | |
| 10,159,334 | B1 * | 12/2018 | Wang | A47B 3/02 |
| 10,206,496 | B1 | 2/2019 | Miller | |
| 10,470,561 | B2 | 11/2019 | Clegg et al. | |
| D895,345 | S | 9/2020 | Leng | |
| 2003/0089286 | A1 | 5/2003 | Wang | |
| 2004/0070235 | A1 * | 4/2004 | Gregory | A47B 3/14 297/158.4 |
| 2004/0195869 | A1 * | 10/2004 | Zhurong | A47B 3/14 297/158.4 |
| 2004/0227382 | A1 | 11/2004 | Lin | |
| 2005/0005826 | A1 | 1/2005 | Strong | |
| 2005/0097829 | A1 | 5/2005 | Seo | |
| 2005/0241550 | A1 | 11/2005 | Neunzert | |
| 2005/0279260 | A1 | 12/2005 | Stanford | |
| 2006/0062632 | A1 | 3/2006 | Jang | |
| 2006/0181114 | A1 * | 8/2006 | Nye | A47B 3/14 297/158.3 |
| 2006/0196395 | A1 | 9/2006 | Lin | |
| 2007/0079441 | A1 | 4/2007 | Chen | |
| 2008/0018142 | A1 | 1/2008 | Yul | |
| 2008/0078310 | A1 | 4/2008 | VanNimwegen | |
| 2013/0000528 | A1 | 1/2013 | Jin | |
| 2013/0025509 | A1 | 1/2013 | Jin | |
| 2013/0233210 | A1 | 9/2013 | Jin | |
| 2014/0030012 | A1 | 1/2014 | Lee | |
| 2014/0070070 | A1 | 3/2014 | Sh I Noda | |
| 2014/0099155 | A1 | 4/2014 | Chen | |
| 2014/0130837 | A1 | 5/2014 | Sy-Facunda | |
| 2016/0348395 | A1 | 12/2016 | Jin | |
| 2017/0013955 | A1 | 1/2017 | Lin | |
| 2017/0340100 | A1 * | 11/2017 | Tsai | A47C 11/00 |
| 2018/0153302 | A1 | 6/2018 | Jiang | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0029684 | A1 | 1/2020 | Jiang | |
| 2021/0106132 | A1 | 4/2021 | Chen | |
| 2021/0112967 | A1 | 4/2021 | Leng | |
| 2021/0112968 | A1 * | 4/2021 | Ponomar | A47B 3/02 |
| 2021/0177135 | A1 * | 6/2021 | Leng | A47B 3/14 |
| 2021/0274929 | A1 * | 9/2021 | Choi | A47B 3/14 |
| 2021/0274930 | A1 * | 9/2021 | Choi | A47B 3/14 |

FOREIGN PATENT DOCUMENTS

| | | | |
|---|---|---|---|
| EP | 1492432 | B1 | 10/2016 |
| WO | WO 2013000149 | A1 | 1/2013 |

* cited by examiner

STRESS-DISPERSING STRUCTURE, FRAME AND TABLE HAVING SAME

CROSS-REFERENCE TO RELATED APPLICATIONS

The present application claims priority to Chinese Utility Model Applications CN 201922188730.X filed Dec. 9, 2019 and CN 202020502707.3 filed Apr. 8, 2020. The disclosure of each application is incorporated herein for all purposes by reference in its entirety.

FIELD OF THE INVENTION

The present invention generally relates to frames and tables. In particular, the present invention relates to foldable frames and tables with structures to disperse localized stresses.

BACKGROUND

Foldable tables are more and more popular these days. A typical foldable table usually includes a tabletop and a supporting frame to support the tabletop. However, many existing foldable tables are configured with no or little means to reduce high stresses in some localized areas. The concentrated stresses could cause damages in the structures. As a result, existing foldable tables are often unstable and their lifespan is relatively short. In addition, some existing foldable tables are difficult to fold and unfold, and thus inconvenient to use.

Given the current state of the art, there remains a need for supporting assemblies, frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides supporting frames and foldable tables with structures to disperse localized stresses.

In various exemplary embodiments, the present disclosure provides a table comprising a tabletop, first and second table leg assemblies, and first and second supporting assemblies. The tabletop has an upper side and a lower side. Each of the first and second table leg assemblies is pivotally coupled with the tabletop and rotatable with respect to the tabletop between a use position and a storage position. The first supporting assembly is pivotally coupled with the tabletop and first table leg assembly, and configured to control rotation of the first supporting assembly with respect to the tabletop. The second supporting assembly is pivotally coupled with the tabletop and second table leg assembly, and configured to control rotation of the second supporting assembly with respect to the tabletop. Each of the first and second supporting assemblies includes first and second supporting members slidably and rotatably coupled with each other, such that sliding and rotating movement between the first and second supporting members of a respective supporting assembly in the first and second supporting assemblies allows a corresponding table leg assembly in the first and second table leg assemblies to rotate with respect to the tabletop between the use and storage positions.

In some exemplary embodiments, the tabletop includes a table panel and a table frame. The table frame includes first and second table mounting members disposed at a lower side of the table panel and spaced apart in a first direction.

In some exemplary embodiment, the table panel includes first and second panel segments. Each of the first and second table mounting members includes first and second table mounting segments pivotally coupled with each other at their adjacent end portions. The first table mounting segments of the first and second table mounting members are disposed at the first panel segment. The first table leg assembly and first supporting assembly are coupled with the first table mounting segments of the first and second table mounting members. The second table mounting segments of the first and second table mounting members are disposed at the second panel segment. The second table leg assembly and second supporting assembly are coupled with the second table mounting segments of the first and second table mounting members. As such, the table can be folded roughly in half. When folded, the lower sides of the first and panel segments face each other with the first and second table leg assemblies and the first and second supporting assemblies in between.

In an exemplary embodiment, the corresponding table leg assembly includes a table leg linking member, first and second legs, and one or more leg links. The table leg linking member has a first end portion pivotally coupled with the first table mounting member and a second end portion pivotally coupled with the second table mounting member. The first and second legs are spaced apart in the first direction, each having an upper end portion fixedly connected with the table leg linking member. Each of the one or more leg links is disposed between the first and second legs and coupled with the first and second legs. The first supporting member of the respective supporting assembly is pivotally connected with a leg link in the one or more leg links of the corresponding table leg assembly.

In another exemplary embodiment, the table frame includes a table leg linking member having a first end portion fixedly coupled with the first table mounting member and a second end portion fixedly coupled with the second table mounting member. The corresponding table leg assembly includes first and second legs, and one or more leg links. The first and second legs are spaced apart in the first direction, each having an upper end portion pivotally connected with the table leg linking member. Each of the one or more leg links is disposed between the first and second legs and coupled with the first and second legs. The first supporting member of the respective supporting assembly is pivotally connected with a leg link in the one or more leg links of the corresponding table leg assembly.

In some exemplary embodiments, the first and second supporting members are coupled with each other by a controller. For instance, the controller is coupled with the first supporting member and movable along a length direction of the first supporting member, and the second supporting member is pivotally coupled with the controller.

In an exemplary embodiment, the controller includes a body configured to sleeve on the first supporting member.

In some exemplary embodiments, the controller includes a pin configured to be selectively inserted into a hole formed at the first supporting member, thereby selectively restricting the movement of the controller along the length direction of the first supporting member.

In some exemplary embodiment, the first supporting member includes a stopper to prevent complete disengagement of the controller from the first supporting member.

In an exemplary embodiment, each of the first and second supporting assemblies includes a third supporting member. The third supporting member has a first end portion pivotally coupled with the first table mounting member and a second end portion pivotally coupled with the second table mounting member. One of the first and second supporting members is pivotally coupled with the corresponding table leg assembly and the other of the first and second supporting members is fixedly coupled with the third supporting member.

In another exemplary embodiment, the first supporting member is pivotally coupled with the corresponding table leg assembly. The second supporting member includes first and second bars. The first bar has a first end portion slidably and rotatably coupled with the first supporting member and a second end portion pivotally coupled with the first table mounting member of the table frame. The second bar has a first end portion slidably and rotatably coupled with the first supporting member and a second end portion pivotally coupled with the second table mounting member of the table frame.

In some exemplary embodiments, the table further includes one or more benchtops, one or more first bench leg assemblies and one or more second bench leg assemblies. Each of the one or more benchtops has an upper side and a lower side. The one or more first bench leg assemblies are adjacent to the first table leg assembly, and the one or more second bench leg assemblies are adjacent to the second table leg assembly. Each respective bench leg assembly in the first and second bench leg assemblies is pivotally coupled with a corresponding benchtop in the one or more benchtops and rotatable with respect to the corresponding benchtop between a use position and a storage position.

In some exemplary embodiments, the one or more first bench leg assemblies are coupled with the first table leg assembly to synchronize rotation of the one or more first bench leg assemblies with respect to the one or more benchtops and rotation of the first table leg assembly with respect to the tabletop. The one or more second bench leg assemblies are coupled with the second table leg assembly to synchronize rotation of the one or more second bench leg assemblies with respect to the one or more benchtops and rotation of the second table leg assembly with respect to the tabletop.

In some exemplary embodiments, when unfolded each of the first and second table leg assemblies is adjustable in height.

In some exemplary embodiments, each of the one or more benchtops includes a bench panel and a bench frame. The bench frame includes first and second bench mounting members spaced apart in a first direction. Each respective bench leg assembly includes a bench leg linking member having a first end portion pivotally coupled to the first bench mounting member and a second end portion pivotally coupled to the second bench mounting member.

In an exemplary embodiment, each of the one or more benchtops further includes a strengthening member disposed between the first and second bench mounting members.

In various exemplary embodiments, the present disclosure provides a table including a table panel, a table frame, first and second table leg assemblies, and first and second supporting assemblies. The table frame includes first and second table mounting members disposed at a lower side of the table panel and spaced apart in a first direction. Each of the first and second table leg assemblies is pivotally coupled with the table frame and rotatable with respect to the table panel between a use position and a storage position. Each of the first and second supporting assemblies includes first, second and third supporting members and a controller. The controller is coupled with the first supporting member and movable along a length direction of the first supporting member. The second supporting member is pivotally coupled with the controller. The third supporting member has a first end portion pivotally coupled with the first table mounting member and a second end portion pivotally coupled with the second table mounting member. One of the first and second supporting members is fixedly coupled with the third supporting member and the other of the first and second supporting members is pivotally coupled with a corresponding table leg assembly in the first and second table leg assemblies. As such, movement of the controller along the length direction of the first supporting member allows the corresponding table leg assembly to rotate with respect to the table panel between the use and storage positions.

In an exemplary embodiment, the corresponding table leg assembly includes a table leg linking member, first and second legs, and one or more leg links. The table leg linking member has a first end portion pivotally coupled with the first table mounting member and a second end portion pivotally coupled with the second table mounting member. The first and second legs are spaced apart in the first direction, each having an upper end portion fixedly connected with the table leg linking member. Each of the one or more leg links is disposed between the first and second legs and coupled with the first and second legs. The first supporting member of the respective supporting assembly is pivotally connected with a leg link in the one or more leg links of the corresponding table leg assembly.

In another exemplary embodiment, the table frame includes a table leg linking member having a first end portion fixedly coupled with the first table mounting member and a second end portion fixedly coupled with the second table mounting member. The corresponding table leg assembly includes first and second legs and one or more leg links. The first and second legs are spaced apart in the first direction, each having an upper end portion pivotally connected with the table leg linking member. Each of the one or more leg links is disposed between the first and second legs and coupled with the first and second legs. The first supporting member of the respective supporting assembly is pivotally connected with a leg link in the one or more leg links of the corresponding table leg assembly.

In various exemplary embodiments, the present disclosure provides a table including a table panel, a table frame, first and second table leg assemblies, and first and second supporting assemblies. The table frame includes first and second table mounting members disposed at a lower side of the table panel and spaced apart in a first direction. Each of the first and second table leg assemblies is pivotally coupled with the table frame and rotatable with respect to the table panel between a use position and a storage position. Each of the first and second supporting assemblies includes first and second supporting members and a controller. The first supporting member is pivotally coupled with a corresponding table leg assembly in the first and second table leg assemblies. The controller is coupled with the first supporting member and movable along a length direction of the first supporting member. The second supporting member includes first and second bars. The first bar has a first end portion pivotally coupled with the controller and a second end portion pivotally coupled with the first table mounting member of the table frame. The second bar has a first end portion pivotally coupled with the controller and a second end portion pivotally coupled with the second table mounting member of the table frame. As such, movement of the controller along the length direction of the first supporting member allows the corresponding table leg assembly to rotate with respect to the table panel between the use and storage positions.

The supporting assemblies, frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
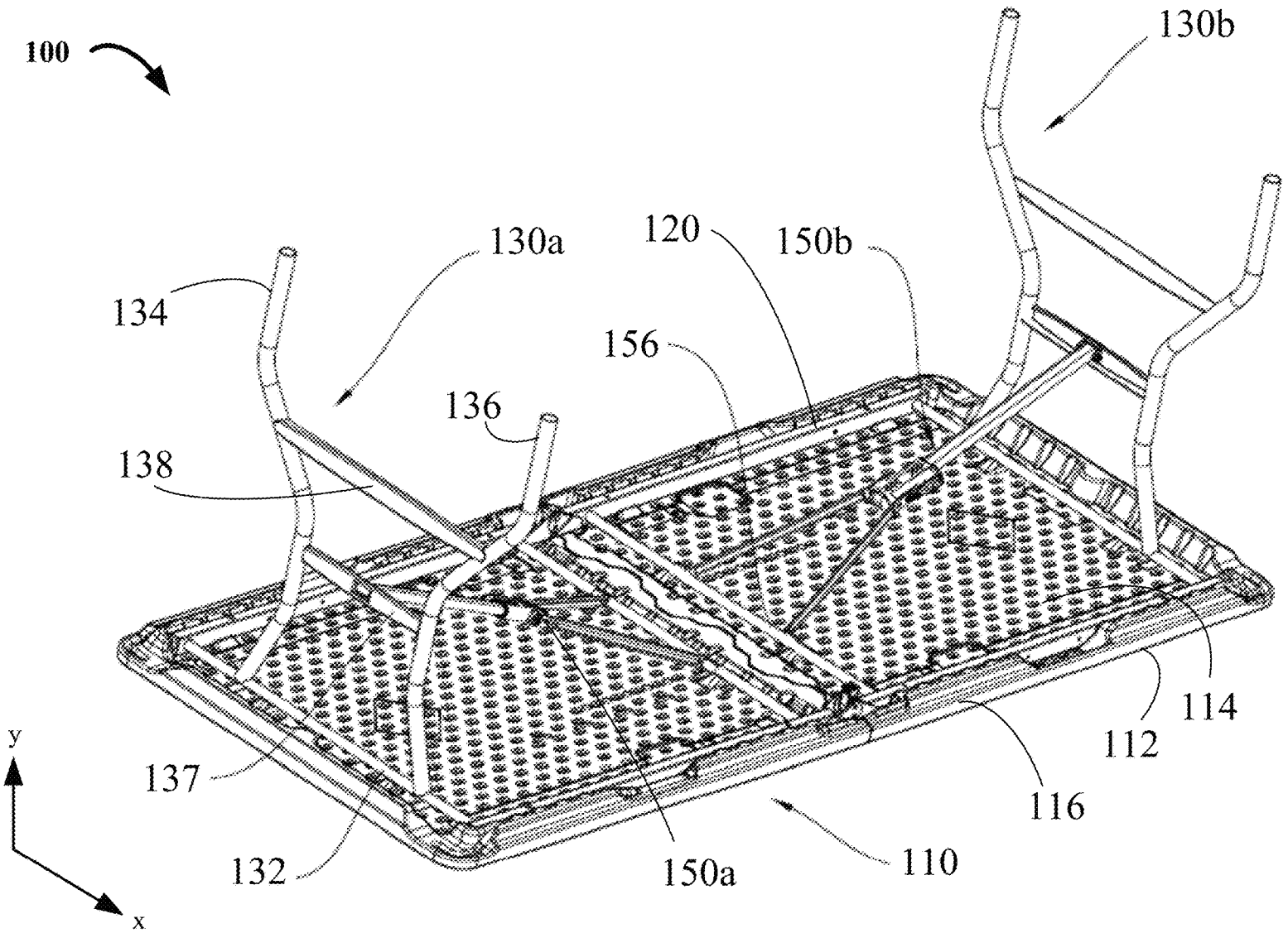
FIG. 1A is a bottom perspective view illustrating an exemplary foldable table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable tables. A foldable table generally includes a tabletop, and one or more leg assemblies each pivotally coupled with the tabletop and rotatable with respect to the tabletop between a use position and a storage position. The foldable table further includes one or more supporting assemblies each pivotally coupled with the tabletop and a corresponding table leg assembly in the one or more leg assemblies. Each supporting assembly is configured to control rotation of the corresponding table leg assembly with respect to the tabletop, reduce localized stresses of the structure (e.g., table or frame), prevent accidental folding of the corresponding table leg assembly, and/or prevent accidental unfolding of the corresponding table leg assembly. In some exemplary embodiments, a table further includes one or more benchtops, and one or more bench leg assemblies. Each of the one or more bench leg assemblies is pivotally coupled with a corresponding benchtop in the one or more benchtops and rotatable with respect to the corresponding benchtop between a use position and a storage position.

A tabletop generally includes a table panel and a table frame disposed at a lower side of the table panel for connecting the table panel with the one or more leg assemblies and the one or more supporting assemblies. Similarly, a benchtop generally includes a bench panel and a bench frame disposed at a lower side of the bench panel for connecting the bench panel with the one or more bench leg assemblies. The table and/or bench panels can be of various shapes including but not limited to a square shape, a round shape or a rectangular shape. The panels can be made of various materials including but not limited to metals, plastics and woods. In some exemplary embodiments, the panels are made of plastics by injection molding, blow molding or any other suitable processes.

The table frame, one or more bench frames, one or more table leg assemblies, one or more supporting assemblies, one or more bench leg assemblies, other additional or optional structures, or any combination thereof, are collectively referred to herein as a supporting frame. The supporting frames of the present disclosure can be made of various materials including but not limited to metals (e.g., iron, steel, and aluminum) and plastics. In some exemplary embodiments, some components of a supporting frame (e.g., bars) are made of metals or the like while some other components (e.g., couplers, sliders) are made of plastics, rubbers or the like.

Figure 1B:
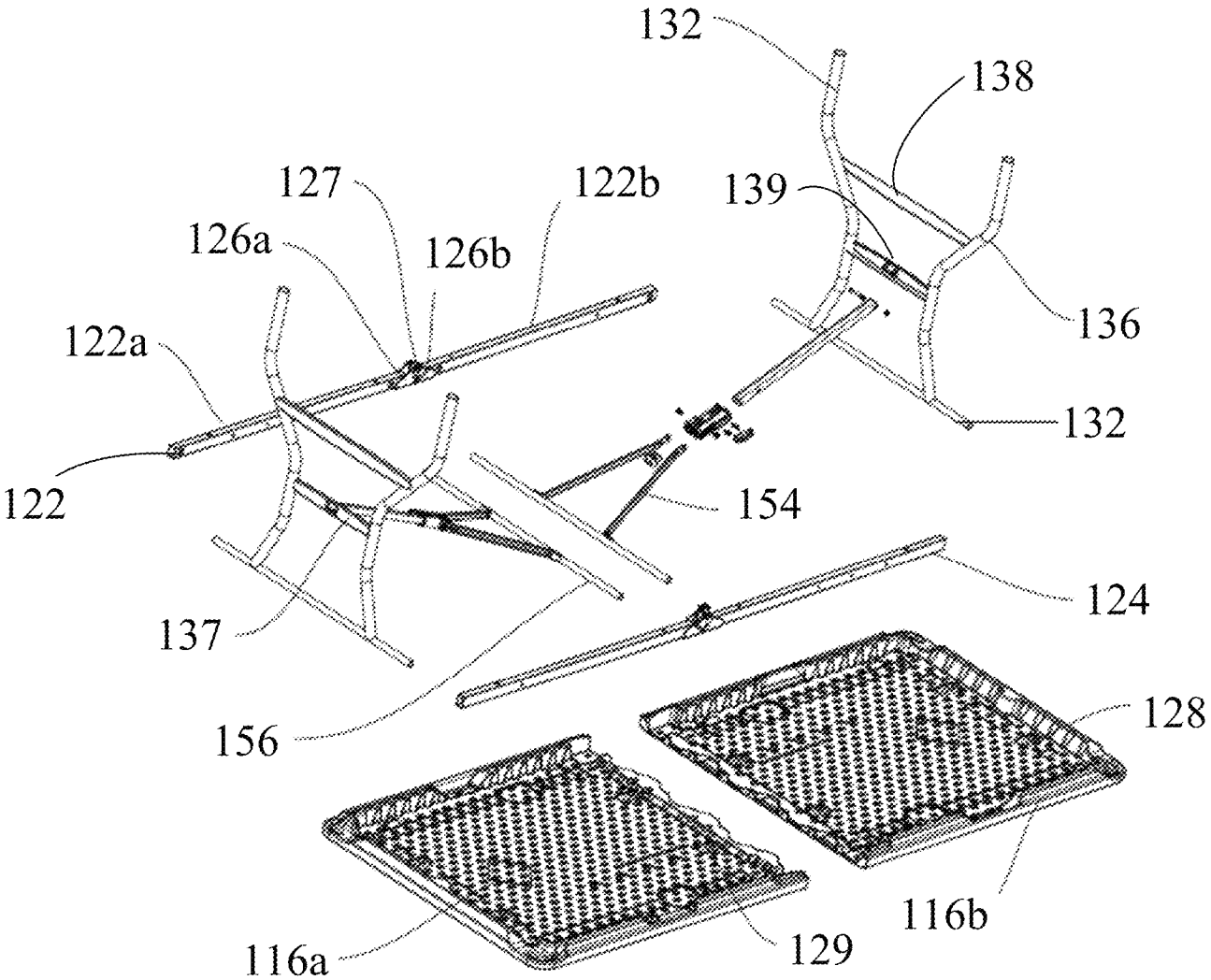
FIG. 1B is a partially dissembled view illustrating the foldable table of FIG. 1A in accordance with exemplary embodiments of the present disclosure.

Referring now to FIGS. 1A and 1B, there is depicted exemplary foldable table 100 in accordance with some exemplary embodiments of the present disclosure. As shown, foldable table 100 includes a tabletop such as tabletop 110 having upper side 112 and lower side 114. Tabletop 110 usually includes a table panel such as table panel 116 and a table frame such as table frame 120 disposed at a lower side of the table panel and configured for connecting the table panel with one or more supporting structures such as table leg assemblies or the like.

The table frame can be integrally formed or coupled with the lower side of the table panel. For instance, in some exemplary embodiments, table frame 120 includes a first table mounting member such as first table mounting member 122 and a second table mounting member such as second table mounting member 124. The first and second table mounting members are disposed at the lower side of the table panel and spaced apart generally in a first direction, e.g., the x-direction in FIG. 1A. In an exemplary embodiment, the first or second table mounting member is a rail, a bar or the like made of a metal. In another exemplary embodiment, at least a portion of the first or second table mounting member is part of the table panel or integrally formed with the table panel.

Figure 3A:
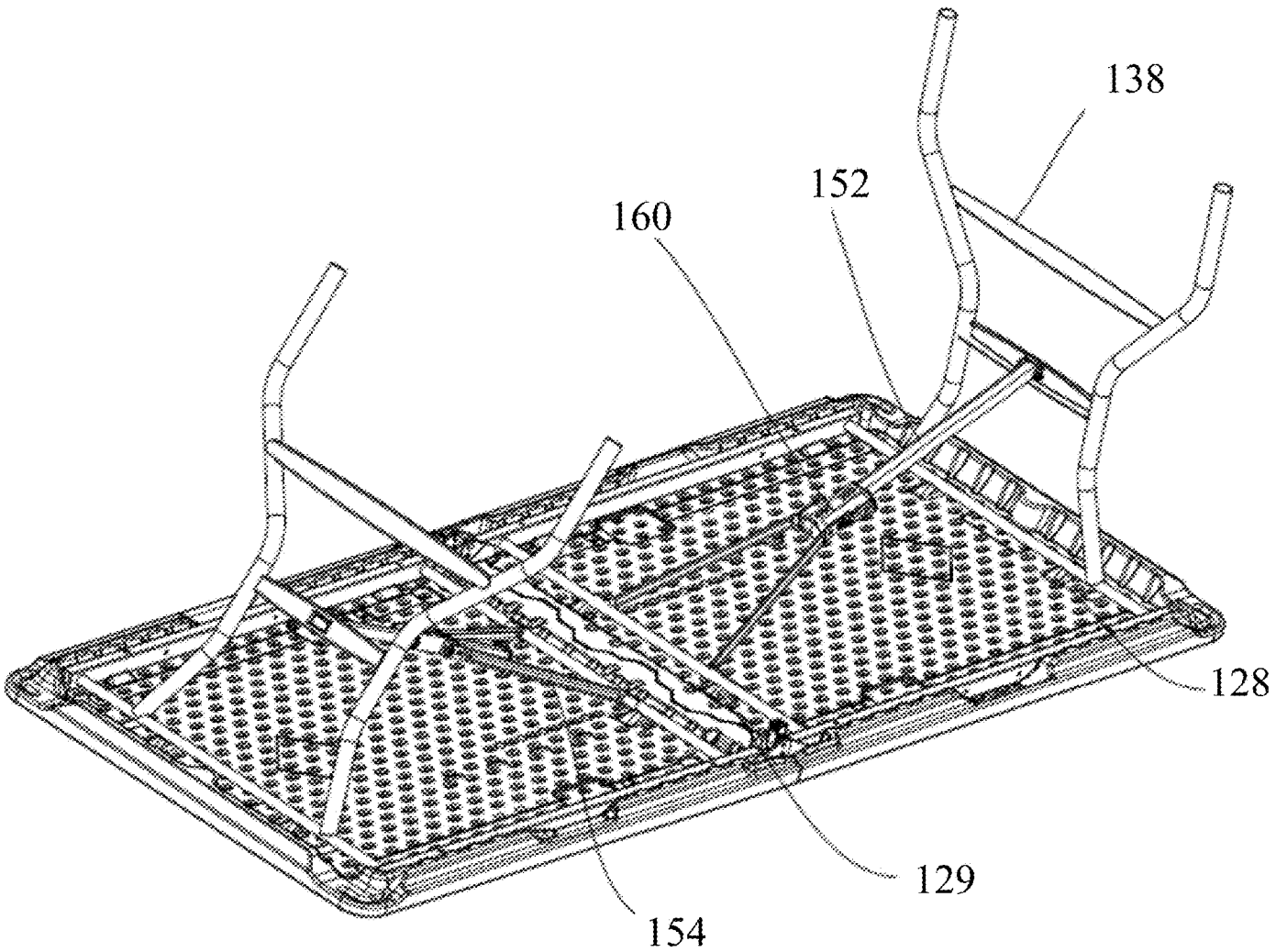
FIG. 3A is a bottom perspective view illustrating the foldable table of FIG. 1A in a first intermediate state in accordance with exemplary embodiments of the present disclosure.
Figure 3B:
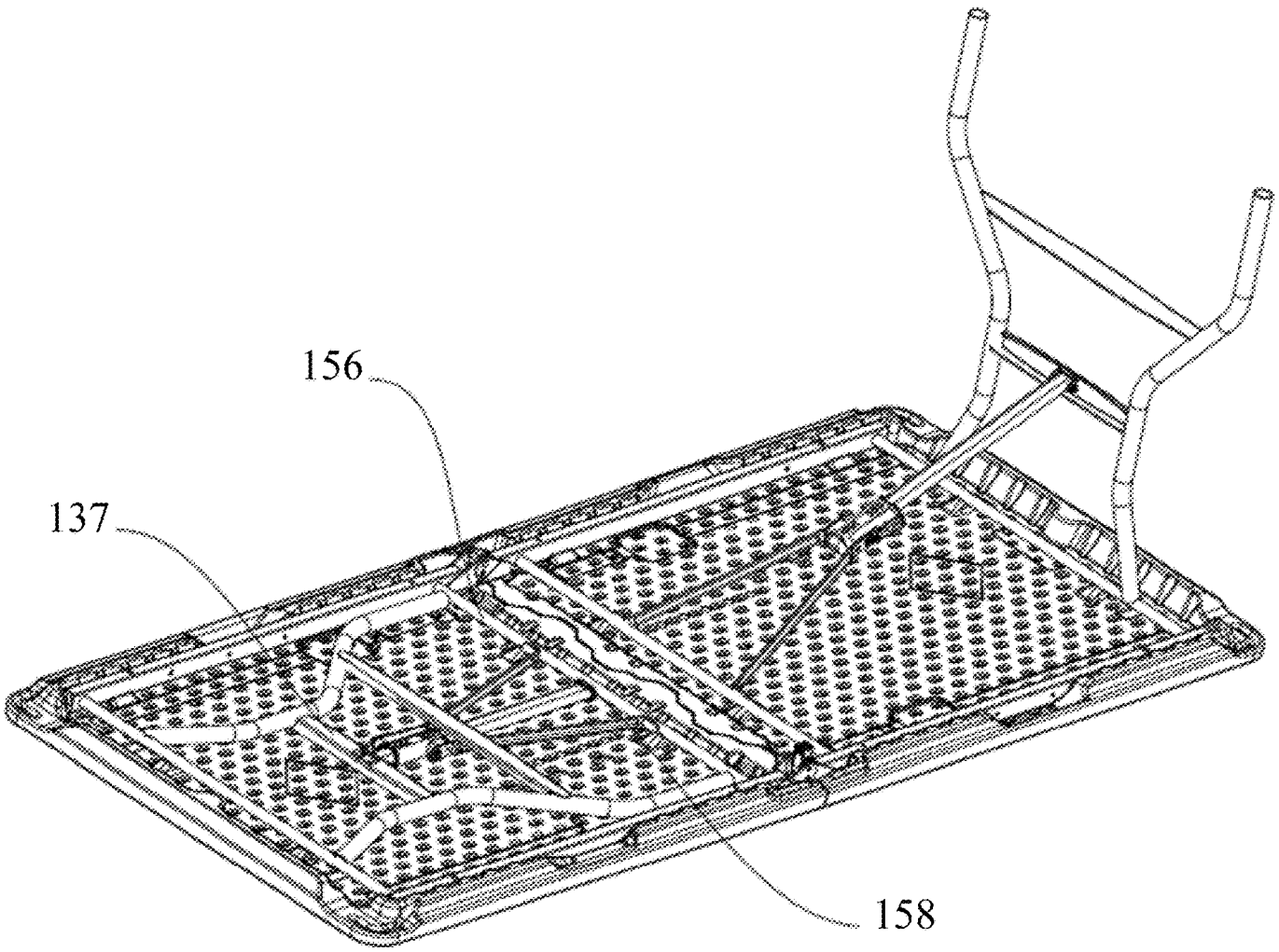
FIG. 3B is a bottom perspective view illustrating the foldable table of FIG. 1A in a second intermediate state in accordance with exemplary embodiments of the present disclosure.
Figure 3C:
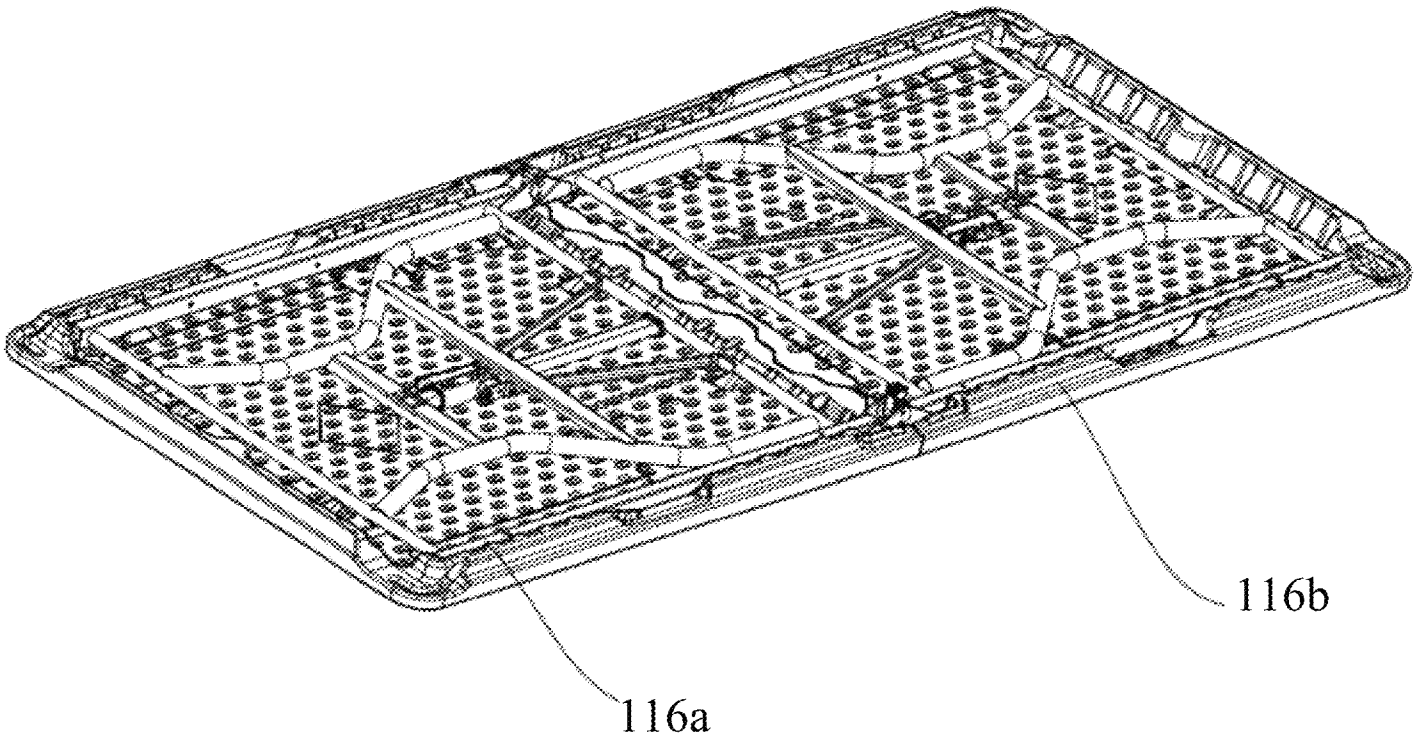
FIG. 3C is a bottom perspective view illustrating the foldable table of FIG. 1A in a third intermediate state in accordance with exemplary embodiments of the present disclosure.

Foldable table 100 also includes one or more table leg assemblies each pivotally coupled with the tabletop and rotatable with respect to the tabletop between a use position and a storage position. For instance, in some exemplary embodiments, foldable table 100 includes first table leg assembly 130*a* and second table leg assembly 130*b*. Each of the first and second table leg assemblies is pivotally coupled with the tabletop and rotatable with respect to the tabletop between a use position as illustrated in FIG. 1A and a storage position as illustrated in FIG. 3C. When in the use positions, the first and second table leg assemblies support the tabletop. When in the storage positions, each of the first and second table leg assemblies is folded onto the tabletop.

In some exemplary embodiments, the first or second table leg assembly of table 100 includes a table leg linking member such as table leg linking member 132 pivotally connected with the tabletop. In an exemplary embodiment, table leg linking member 132 is a crossbar or the like, having a first end portion pivotally coupled with first table mounting member 122 and a second end portion pivotally coupled with second table mounting member 124. For instance, the first or second end portion of table leg linking member 132 is inserted into a hole formed at the first or second table mounting member. In an exemplary embodiment, the first or second end portion of table leg linking member 132 has an oval cross section or the like, configured to aid the rotation of the first or second table leg assembly and to stabilize the first or second table leg assembly when in use. Examples of such configurations are disclosed in U.S. patent application Ser. No. 16/838,939, Ser. No. 16/838,944 and Ser. No. 16/838,947, the disclosure of each application is incorporated herein for all purposes by reference in its entirety.

In some exemplary embodiments, to assist in portioning table leg linking member 132 and/or to ensure smooth rotation of the table leg assembly, the table panel includes one or more retainers such as first retainer 128. The one or more retainers are coupled with or formed at the lower side of the table panel. They usually protrude beyond the general lower surface of the table panel to prevent direct contact of the table leg linking member with the general lower surface of the table panel. In an exemplary embodiment, the first retainer is formed with a recess to receive crosswise at least a portion of the table leg linking member. Examples of retainers are disclosed in U.S. patent application Ser. No. 16/839,337, the disclosure of the application is incorporated herein for all purposes by reference in its entirety.

The first or second table leg assembly of table 100 also includes one or more legs each having an upper end portion fixedly connected with the table leg linking member. For instance, in some exemplary embodiments, the first or second table leg assembly includes a first leg such as first leg 134 and a second leg such as second leg 136. The first and second legs are spaced apart in the first direction, each having an upper end portion fixedly connected with the table leg linking member. Each of the first and second legs can have any suitable shapes. In an exemplary embodiment, middle portions of the first and second legs are arched toward each other with a relatively larger distance between the upper portions of the first and second legs or between the lower portions of the first and second legs. The arched first and second legs enhance the stability of the table when in use.

In some exemplary embodiments, to further enhance the strength of the first or second table leg assembly, the first and second legs are connected with each other by one or more leg links. For instance, by way of example, FIGS. 1A and 1B illustrate two leg links, e.g., first leg link 137 and second leg link 138, each disposed between the first and second legs and coupled with the first and second legs.

Foldable table 100 further includes one or more supporting assemblies configured to control the rotation (e.g., folding and unfolding) of the one or more table leg assemblies with respect to the tabletop, and/or to stabilize the one or more table leg assemblies when in the use positions. For instance, in some exemplary embodiments, foldable table 100 includes a first supporting assembly such as first supporting assembly 150*a* and a second supporting assembly 150*b*. The first supporting assembly is pivotally coupled with the tabletop and first table leg assembly and configured to control the rotation of the first table leg assembly with respect to the tabletop. When the table is in use, the first supporting assembly holds the first table leg assembly in its use position and prevents the first table leg assembly from rotating with respect to the tabletop. Similarly, the second supporting assembly is pivotally coupled with the tabletop and second table leg assembly, and configured to control rotation of the second table leg assembly with respect to the tabletop. When the table is in use, the second supporting assembly holds the second table leg assembly in its use position and prevents the second table leg assembly from rotating with respect to the tabletop.

In some exemplary embodiments, the first or second supporting assembly includes a first supporting member such as first supporting member 152 and a second supporting member such as second supporting member 154. The first and second supporting members are slidably and rotatably coupled with each other, for instance, by a controller such as controller 160. In some exemplary embodiments, the first or second supporting assembly further includes one or more additional or optional members such as third supporting member 156 pivotally connected with the tabletop. For instance, in an exemplary embodiment, third supporting member 156 is a crossbar or the like, having a first end portion pivotally coupled with first table mounting member 122 and a second end portion pivotally coupled with second table mounting member 124. The third supporting member is disposed at a middle portion of the tabletop. When the table is unfolded, the supporting assembly forms a triangular structure along with the table frame and the corresponding table leg assembly. As such, the supporting assembly (through the third supporting member) disperses the stresses that could otherwise be concentrated at the locations where the table leg assembly is connected with the table frame. Consequently, the supporting assemblies of the present disclosure not only enhance the stability of the table but also reduce the localized stresses and thus prolong the lifespan of the tables.

In some exemplary embodiments, to assist in positioning third supporting member 156 and/or to ensure smooth rotation of the supporting assembly, the table panel includes one or more retainers such as second retainers 129. The second retainers are coupled with or formed at the lower side of the table panel and can have the same configuration (e.g., size or shape) as the first retainers or different configurations. The second retainers usually protrude beyond the general lower surface of the table panel to prevent direct contact of the third supporting member with the general lower surface of the table panel. In an exemplary embodiment, the second retainer is formed with a recess to receive crosswise at least a portion of the third supporting member.

The third supporting member can be used to fixedly couple with either the first or second supporting member. By way of example, FIGS. 1A and 1B illustrate the second supporting member is fixedly coupled with the third supporting member while the first member is pivotally coupled with first leg link 137 of the corresponding first or second table leg assembly. In an exemplary embodiment, the first member is pivotally coupled with first leg link 137 of the corresponding first or second table leg assembly through a coupler such as coupler 139. Coupler 139 can include a bracket, a bolt or the like.

Figure 2A:
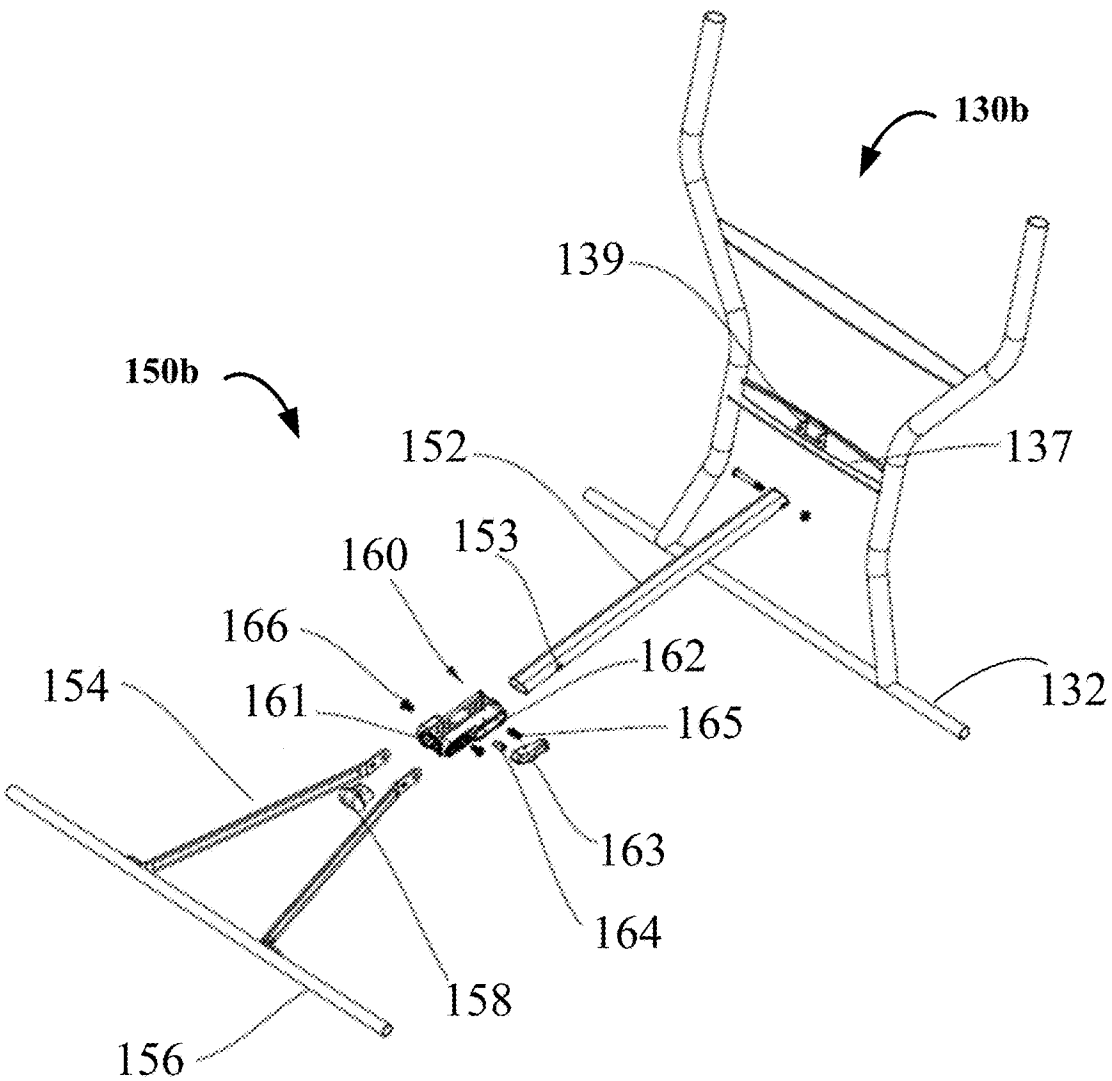
FIG. 2A is a partially dissembled view illustrating some components of the foldable table of FIG. 1A in accordance with exemplary embodiments of the present disclosure.
Figure 2B:
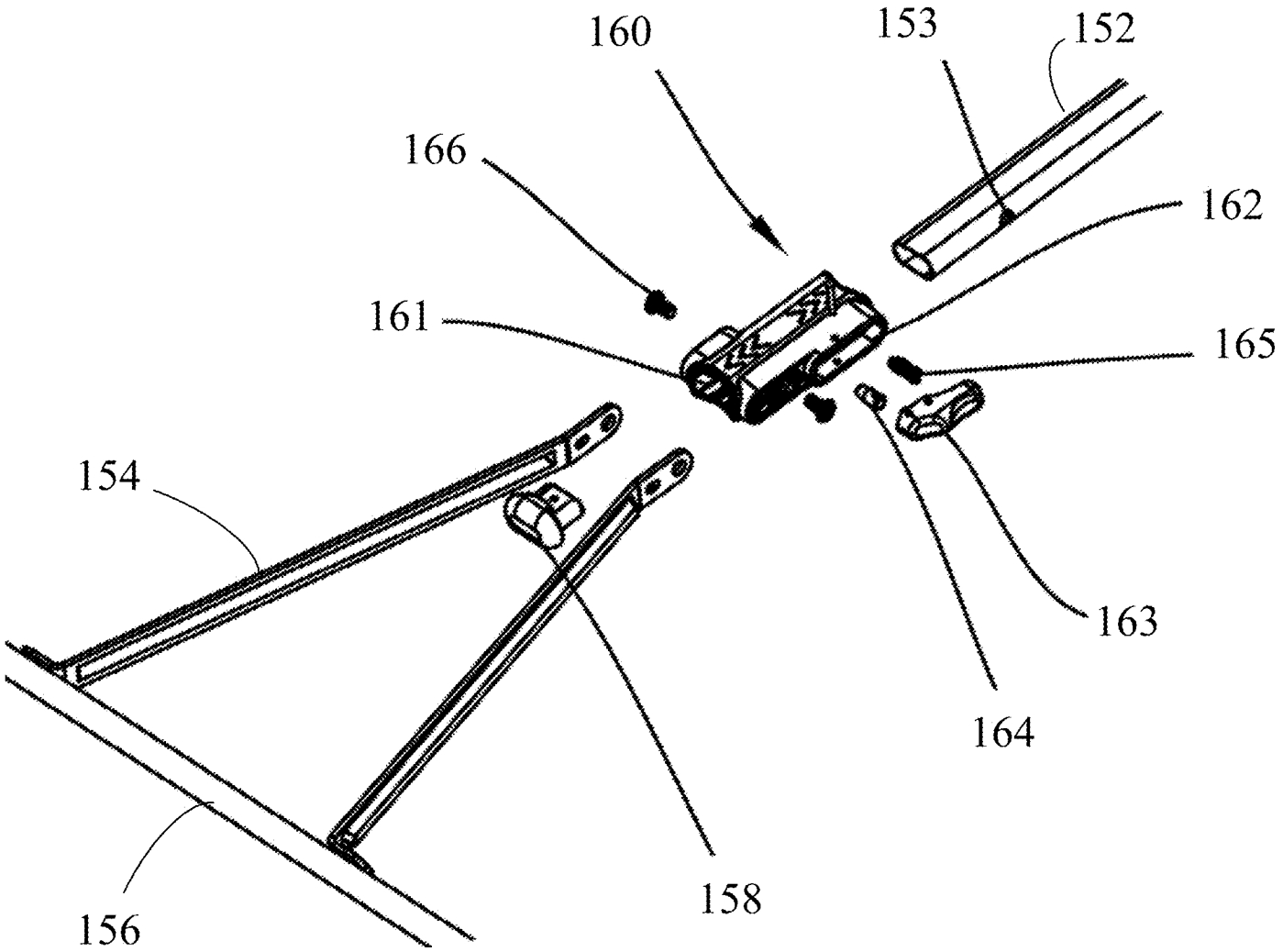
FIG. 2B is a partially enlarged view of FIG. 2A.

Referring to FIGS. 2A and 2B, in some exemplary embodiments, the second supporting member includes one or more supporting bars. For instance, in the illustrated embodiment, the second supporting member includes two supporting bars, one on each side of the controller. Each of these two supporting bars has an end portion pivotally connected with controller 160 by a fastener such as fastener 166 and another end portion fixedly coupled with the third supporting member.

In some exemplary embodiments, controller 160 is coupled with the first supporting member and movable along a length direction of the first supporting member. The second supporting member is pivotally coupled with the controller. As such, while the controller moves along the length direction of the first supporting member, the first and second supporting members move toward or away from each other, resulting in shortening or lengthening the total length of the supporting assembly (e.g., the distance between first leg link 137 of the corresponding table leg assembly and third supporting member 156). Moreover, while moving toward or away from each other, each of the first and second supporting members also rotates. For instance, the first supporting member rotates around the pivoting axis at which the first supporting member is pivotally connected with the corresponding table leg assembly. The second supporting member rotates around the pivoting axis at which the second supporting member is pivotally connected with the controller. In addition, the second support member rotates with respect to the tabletop through the third supporting member. As such, the first or second supporting assembly allows the corresponding table leg assembly to rotate between the use and storage positions.

In some exemplary embodiments, controller 160 is configured to be a slider or to include a slider similar to those disclosed in U.S. patent application Ser. No. 16/838,939, Ser. No. 16/838,944 and Ser. No. 16/838,947, the disclosure of each application is incorporated herein for all purposes by reference in its entirety. For instance, referring to FIGS. 2A and 2B, in some exemplary embodiments, controller 160 includes a body such as body 161 configured to sleeve on first supporting member 152. Controller 160 also includes a casing such as casing 162, a lever (or button) such as lever 163, a pin such as pin 164 and/or an elastic member such as elastic member 165. The casing is integrally formed (e.g., by molding) or coupled (e.g., glued or fastened) with a side wall of the body. The lever is pivotally coupled with the casing. The pin is integrally formed or coupled with the level and disposed in the casing with a free end toward the interior of the body. The elastic member is disposed in the casing and has one end abutting the bottom of the casing (e.g., the side wall of the sleeve) and another end abutting the lever. The pin and elastic member are disposed at opposite sides of the pivotal point at which the lever is connected with the casing. Thus, when a hole such as hole 153 of the first supporting member is aligned with the controller, the elastic member pushes the free end of the pin into the hole of the first supporting member, thereby restricting the body from moving along the first supporting member, and accordingly restricting the controller and thus the second supporting member from moving along the first supporting member. Pressing the elastic member side of the lever toward the body will remove the free end of the pin from the hole of the first supporting member, thereby disengaging the body from the first supporting member and thus allowing the controller to move along the first supporting member.

In some exemplary embodiments, first supporting member 152 includes a stopper such as stopper 158. The stopper is disposed at an end portion of the first supporting member that is adjacent to the second support member, and configured to prevent complete disengagement of controller 160 from the first supporting member. For instance, in an exemplary embodiment, the stopper prevents body 161 of the controller from sliding off the first supporting member.

Referring back to FIGS. 1A and 1B, in some exemplary embodiments, table panel 116 includes multiple panel segments such as first panel segment 116*a* and second panel segment 116*b*. First table mounting member 122 includes multiple table mounting segments such as first table mounting segment 122*a* and second table mounting segment 122*b* that are pivotally coupled with each other at their adjacent end portions. Similarly, second table mounting member 124 includes multiple table mounting segments that are pivotally coupled with each other at their adjacent end portions. In an exemplary embodiment, the first or second table mounting segment includes a coupling piece such as first coupling piece 126*a* at its proximal end, the second table mounting segment includes a coupling piece such as second coupling piece 126*b* at its proximal end, and a coupling piece such as third coupling piece 127 that pivotally connects the first and second coupling pieces. Examples of pivotally coupling mounting segments and/or coupling pieces are disclosed in U.S. patent application Ser. No. 16/838,939, Ser. No. 16/838,944 and Ser. No. 16/839,337, the disclosure of each application is incorporated herein for all purposes by reference in its entirety.

The first table mounting segments of the first and second table mounting members are disposed at (e.g., coupled or formed with) the first panel segment. The second table mounting segments of the first and second table mounting members are disposed at the second panel segment. The first table leg assembly and first supporting assembly are coupled with the first table mounting segments of the first and second table mounting members. The second table leg assembly and second supporting assembly are coupled with the second table mounting segments of the first and second table mounting members. As such, the table can be generally folded in half.

Figure 3D:
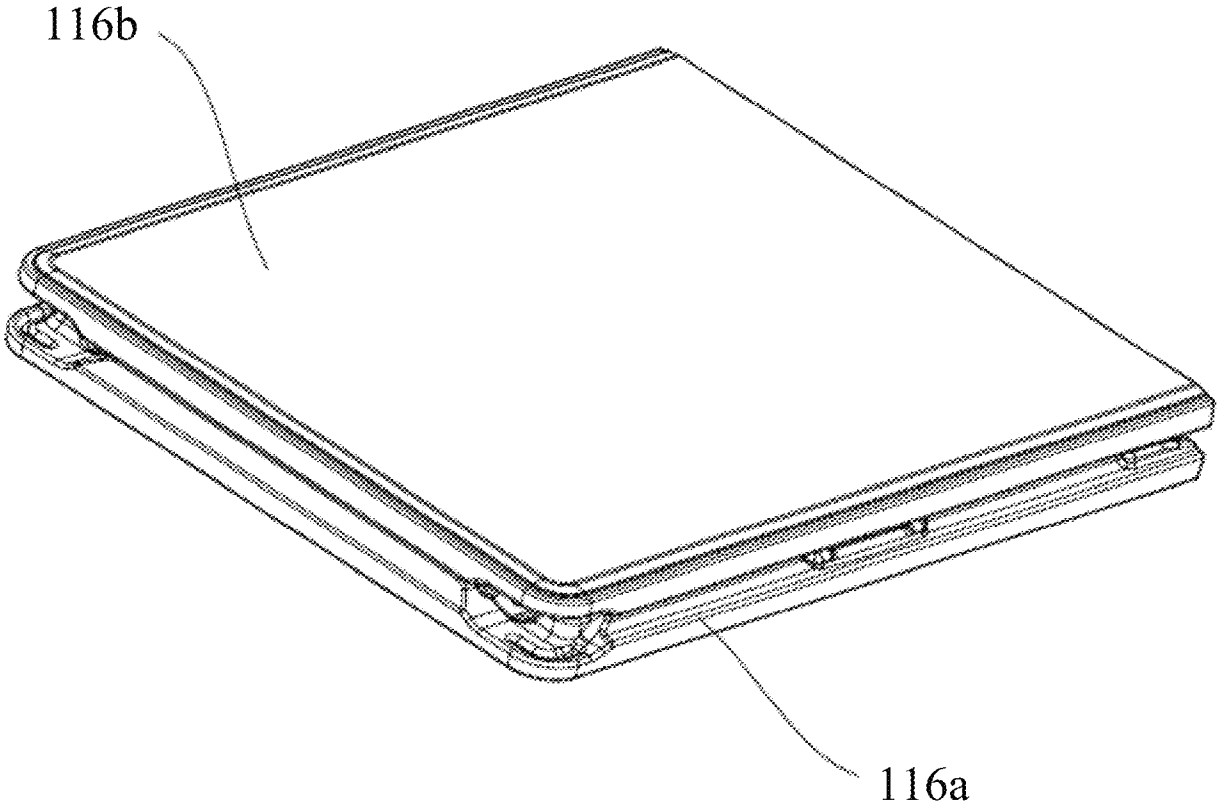
FIG. 3D is a bottom perspective view illustrating the foldable table of FIG. 1A in a folded state in accordance with exemplary embodiments of the present disclosure.

Folding and unfolding of table 100 is simple and easy. For instance, the first table leg assembly can be folded toward the first table panel segment and the second table leg assembly can be folded toward the second table panel segment as illustrated in FIGS. 3A-3C. Once the first and second table leg assemblies are folded, the combination of the first table panel segment, first table leg assembly and other relevant components and the combination of the second table panel segment, second table leg assembly and other relevant components can be folded toward each other. The resulting folded table is illustrated in FIG. 3D. As shown, when folded, the lower sides of the first and panel segments face each other with the first and second table leg assemblies and the first and second supporting assemblies in between. In addition, the size of the table when folded is roughly half of the unfolded table. Reversing the processes unfolds the table.

Figure 4A:
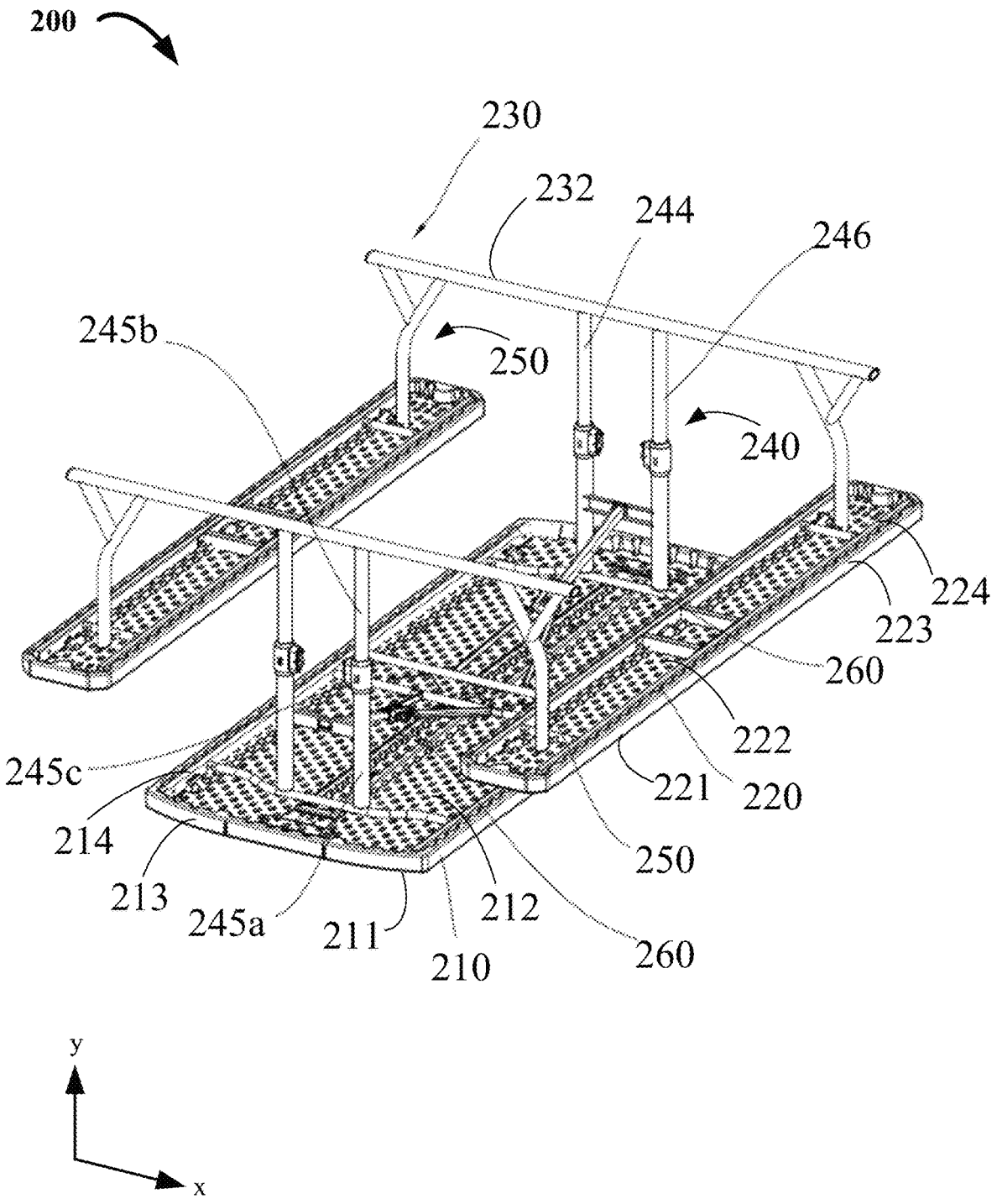
FIG. 4A is a perspective view illustrating an exemplary foldable table in an unfolded state in accordance with exemplary embodiments of the present disclosure.
Figure 4B:
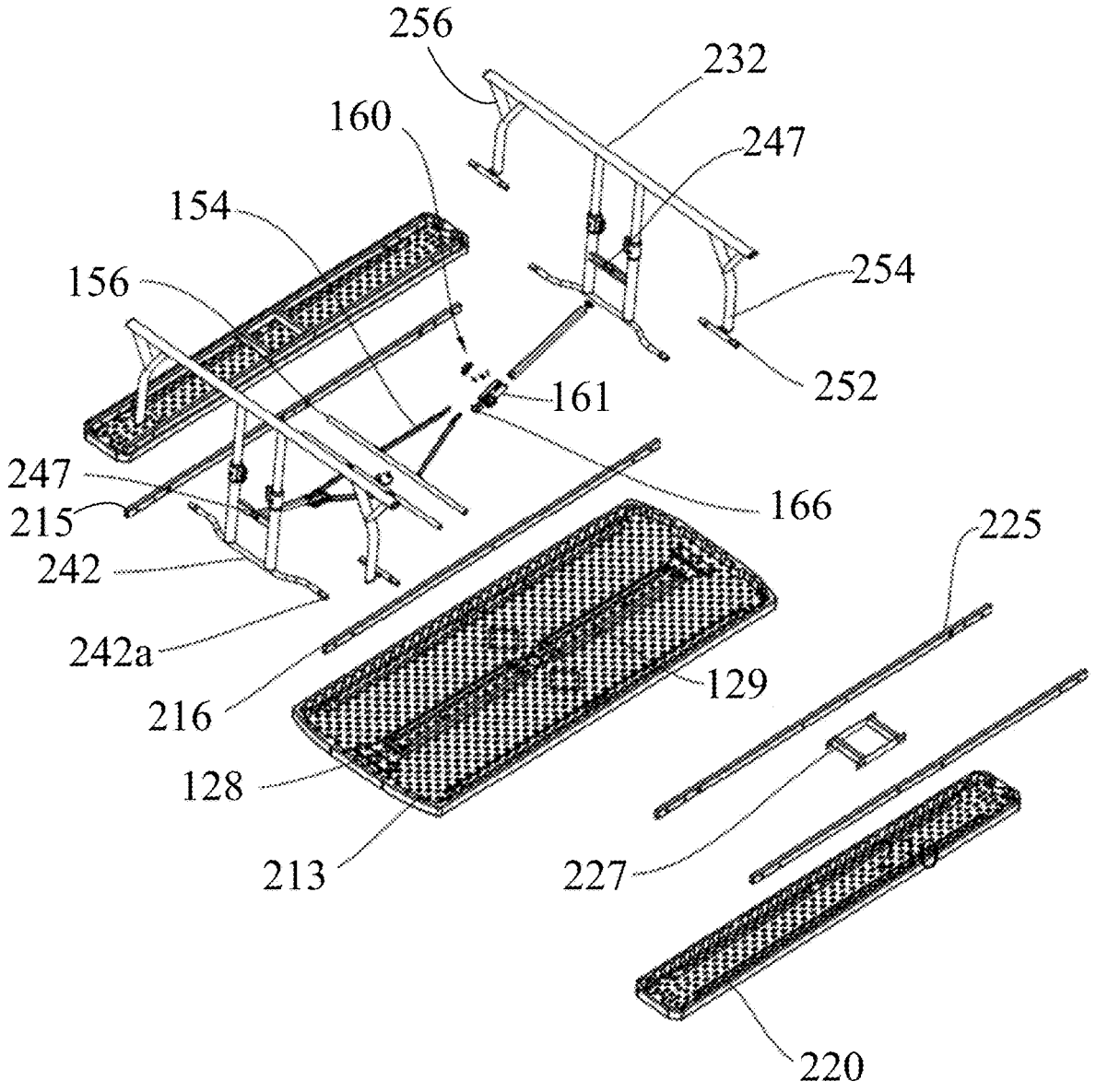
FIG. 4B is a partially dissembled view illustrating the foldable table of FIG. 4A in accordance with exemplary embodiments of the present disclosure.

Referring now to FIGS. 4A and 4B, there is depicted exemplary picnic table 200 in accordance with some exemplary embodiments of the present disclosure. Picnic table 200 includes a tabletop such as tabletop 210, one or more benchtops such as benchtop 220, and one or more leg assemblies such as leg assembly 230 to support the tabletop and one or more benchtops. In some exemplary embodiments, leg assembly 230 includes a table leg assembly such as table leg assembly 240 to support the tabletop and one or more bench leg assemblies such as bench leg assembly 250 to support the one or more benchtops. By way of example, FIGS. 4A and 4B illustrate two benchtops and two leg assemblies. The two benchtops can be the same as or different from each other. Similar, the two leg assemblies can be the same as or different from each other. In the illustrated embodiment, leg assembly 230 includes two bench leg assemblies 250, each supporting a corresponding benchtop 220.

In some exemplary embodiments, tabletop 210 has an upper side and a lower side, and includes a table panel and a table frame. For instance, in an exemplary embodiment, tabletop 210 has upper side 211 and lower side 212, and includes table panel 213 and table frame 214. Table frame 214 is integrally formed or coupled with a lower side of table panel 213 for connecting table leg assembly 240 such that table leg assembly 240 is rotatable with respect to table panel 213 or tabletop 210. In some exemplary embodiments, table frame 214 includes a first table mounting member such as first table mounting member 215 and a second table mounting member such as second table mounting member 216. The first and second table mounting members are spaced apart generally in a first direction, e.g., the x-direction in FIG. 4A. As used herein, the term "spaced apart" does not necessarily require the two components be parallel to each other, and does not necessarily require complete physical separation of the two components.

Similar to tabletop 210, in some exemplary embodiments, benchtop 220 has an upper side and a lower side, and includes a bench panel and a bench frame. For instance, in an exemplary embodiment, benchtop 220 has upper side 221 and lower side 222, and includes bench panel 223 and bench frame 224. Bench frame 224 is integrally formed or coupled with a lower side of bench panel 223 for connecting bench leg assembly 250 such that bench leg assembly 250 is rotatable with respect to bench panel 223 or benchtop 220. In some exemplary embodiments, bench frame 224 includes a first bench mounting member such as first bench mounting member 225 and a second bench mounting member such as second bench mounting member 226. The first and second bench mounting members are spaced apart generally in the first direction. In some exemplary embodiments, bench frame 224 includes additional or operational members. For instance, in an exemplary embodiment, bench frame 224 includes an additional member such as strengthening member 227 disposed at the middle portion of the benchtop and between the first and second bench mounting members. Strengthening member 227 disperses local stresses and enhances the strength and stability of the benchtop.

Table leg assembly 240 is pivotally coupled with the tabletop and rotatable with respect to the tabletop. For instance, in some exemplary embodiments, table leg assembly 240 includes a table leg linking member such as table leg linking member 242 pivotally connected with the first and second table mounting members of the table frame. In an exemplary embodiment, table leg linking member 242 or the end portion 242*a* is substantially the same as or similar to table leg linking member 132 disclosed herein (e.g., having an oval cross section such as end portion or the like at an end portion).

In some exemplary embodiments, table leg assembly 240 also includes one or more legs each having an upper end portion fixedly connected with table leg linking member 242. For instance, in some exemplary embodiments, table leg assembly 240 includes a first leg such as first leg 244 and a second leg such as second leg 246. The first and second legs are spaced apart in the first direction, each having an upper end portion fixedly connected with the table leg linking member. In some exemplary embodiments, to further enhance the strength of the first or second table leg assembly, the first and second legs are connected with each other by one or more leg links. For instance, by way of example, FIGS. 4A and 4B illustrate one leg link, e.g., first leg link 247, disposed between the first and second legs and coupled with the first and second legs.

In some exemplary embodiments, each of the first and second legs of table leg assembly 240 is adjustable in length. For instance, in an exemplary embodiment, each of the first and second legs of table leg assembly 240 includes first bar 245*a* and second bar 245*b* telescopically coupled with each other and locking/unlocking mechanism 245*c* to control relative movement of the first and second bars. Examples of adjustable leg assemblies and/or other relevant features are disclosed in U.S. patent application Ser. No. 15/400,861, Ser. No. 15/931,925, Ser. No. 16/838,939, Ser. No. 16/838,944, Ser. No. 17/000,661, Ser. No. 17/003,047, Ser. No. 17/038,369 and Ser. No. 17/069,458, the disclosure of each application is incorporated herein for all purposes by reference in its entirety. As such, when unfolded, one can change the height of the table panel by adjusting collectively the lengths of table leg assemblies 240 of the leg assemblies. In some exemplary embodiments, the height of the table panel is adjustable between a first position at which the table panel is positioned higher than the one or more bench panels and a second position at which the table panel is positioned at a level substantially the same as the one or more bench panels. In an exemplary embodiment, there exists at least one intermediate position between the first and second positions. When the table panel is aligned with the one or more bench panels, the leg assembly can be folded onto the table and bench panels, thereby making the picnic table compact and convenient for storage and transportation.

Bench leg assembly 250 is pivotally coupled with the benchtop and rotatable with respect to the benchtop. For instance, in some exemplary embodiments, bench leg assembly 250 includes a bench leg linking member such as bench leg linking member 252 pivotally connected with the first and second bench mounting members of the bench frame. In an exemplary embodiment, bench leg linking member 252 is substantially the same as or similar to table leg linking member 132 disclosed herein (e.g., having an oval cross section or the like at an end portion).

Bench leg assembly 250 can include one or more bench legs. For instance, in some exemplary embodiments, bench leg assembly 250 includes two bench legs such as first bench leg 254 and second bench leg 256. In an exemplary embodiment, the first and second bench legs are coupled with each other and collectively form a structure of a substantially "Y" shape as illustrated in FIG. 4A.

In some exemplary embodiments, the one or more bench leg assemblies are coupled with the table leg assembly, for instance, by a connecting member such as connecting member 232. As such, the rotation of the one or more first bench leg assemblies with respect to the one or more benchtops can be synchronized with the rotation of the first table leg assembly with respect to the tabletop, e.g., each leg assembly 230 rotating as one unit between a use position as illustrated in FIG. 4A and a storage position as illustrated in FIG. 5D. When in the use positions, the leg assemblies support the tabletop and one or more benchtops. When in the storage positions, each table leg assembly is folded onto the tabletop and each bench leg assembly is folded onto the benchtop.

In some exemplary embodiments, picnic table 200 further includes one or more supporting assemblies such as supporting assembly 260 configured to control the rotation (e.g., folding and unfolding) of the one or more table leg assemblies with respect to the tabletop, and/or to lock the one or more table leg assemblies when desired. By way of example, FIGS. 4A and 4B illustrate two supporting assemblies, which can be the same or different from each other. Each supporting assembly 260 is pivotally connected with the table frame and a corresponding table leg assembly. For instance, in an exemplary embodiment, supporting assembly 260 is configured substantially the same as first supporting assembly 150*a* or second supporting assembly 150*b*. It includes first supporting member 152 and second supporting member 154 slidably and rotatably coupled with each other by controller 160. In addition, first supporting member 152 is pivotally coupled with table leg assembly 240, for instance, coupled with first leg link 247 of table leg assembly 240. Second supporting member 154 is pivotally coupled with the tabletop through third supporting member 156. As such, supporting assembly 260 controls rotation of the table leg assembly with respect to the tabletop. When the table is in use, supporting assembly 260 holds the table leg assembly in its use position and prevents the table leg assembly from rotating with respect to the tabletop. As such, the table is very stable and safe to use.

Figure 5A:
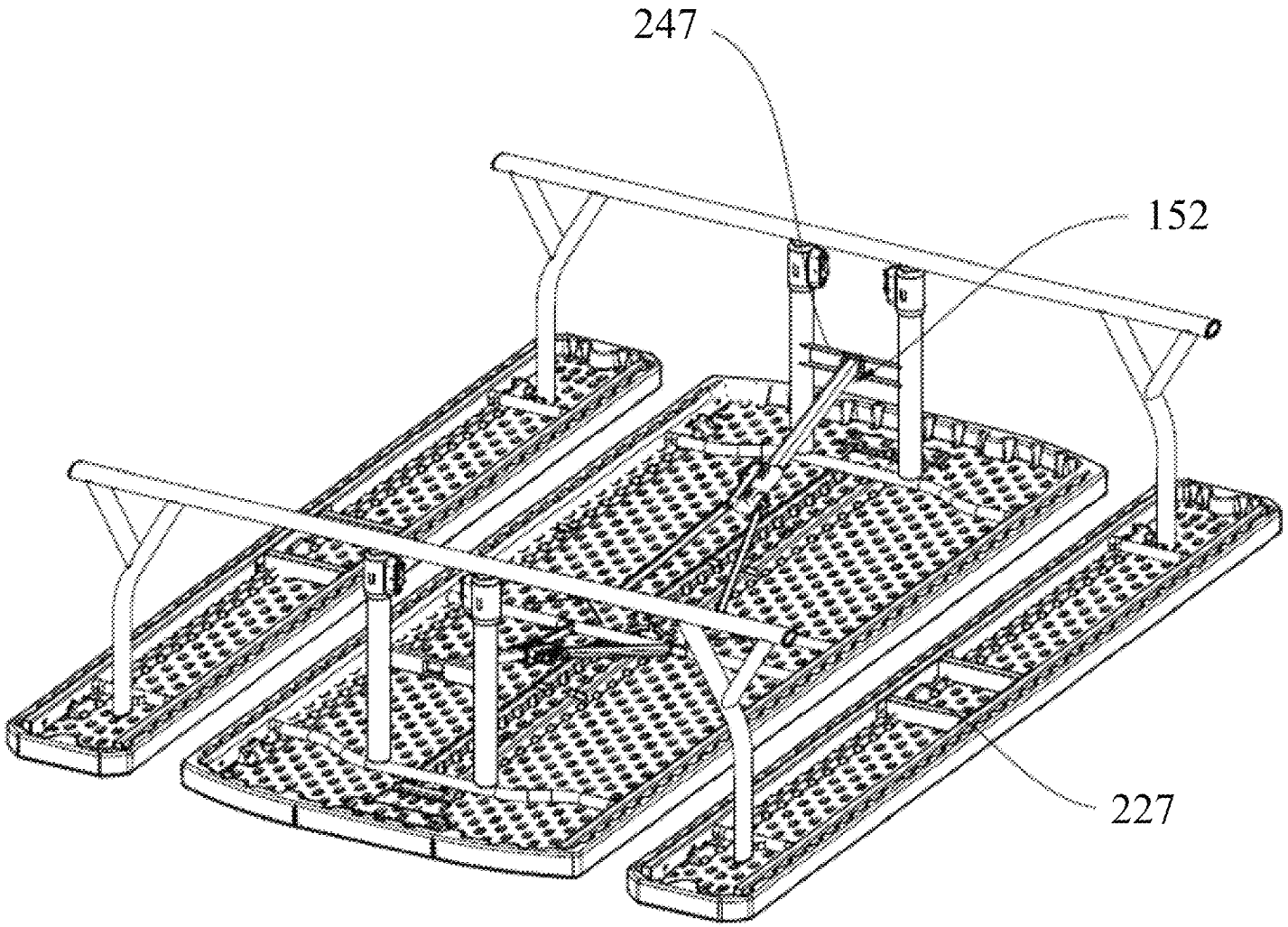
FIG. 5A is a bottom perspective view illustrating the foldable table of FIG. 4A in a first intermediate state in accordance with exemplary embodiments of the present disclosure.
Figure 5B:
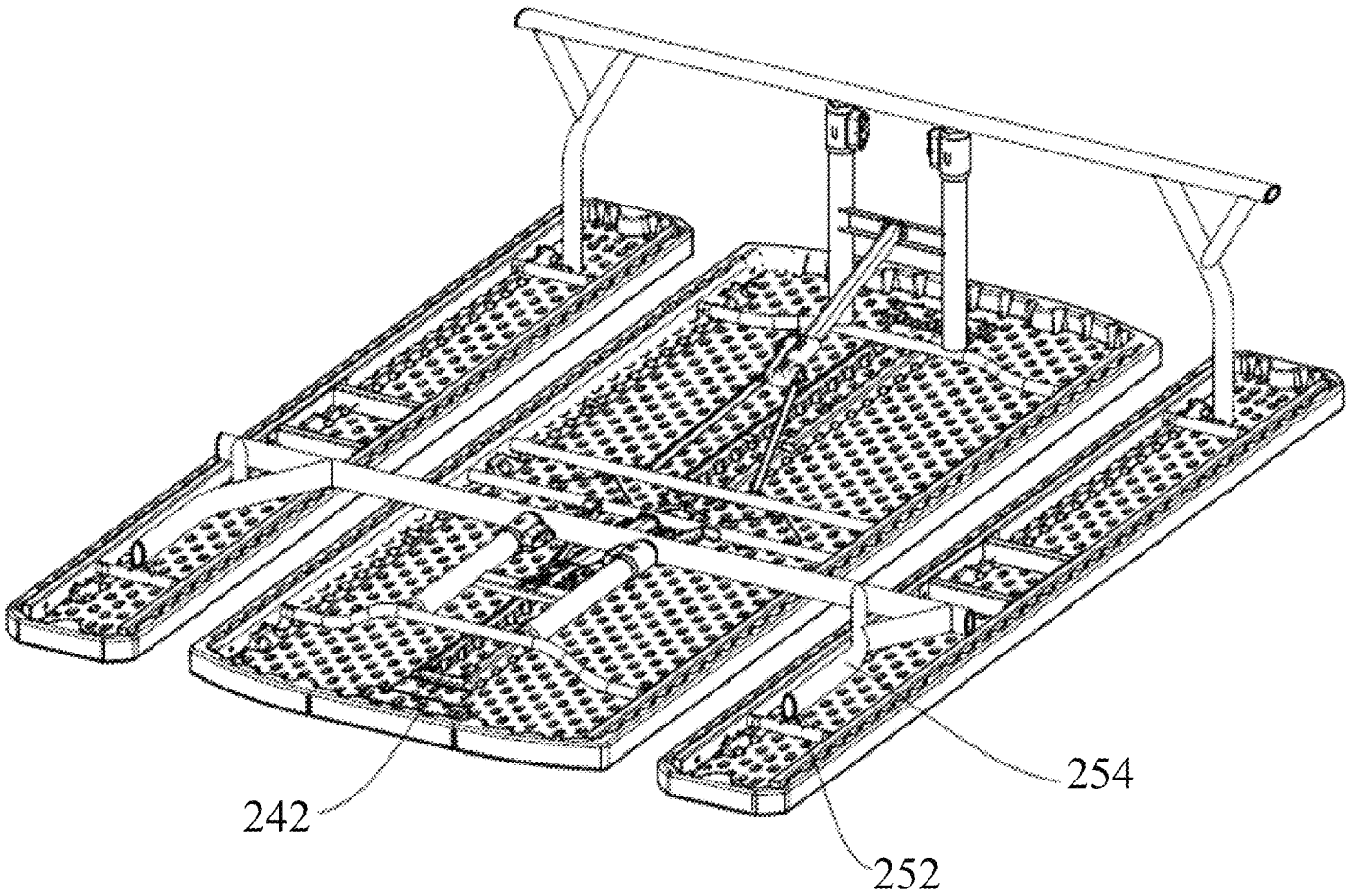
FIG. 5B is a bottom perspective view illustrating the foldable table of FIG. 4A in a second intermediate state in accordance with exemplary embodiments of the present disclosure.
Figure 5C:
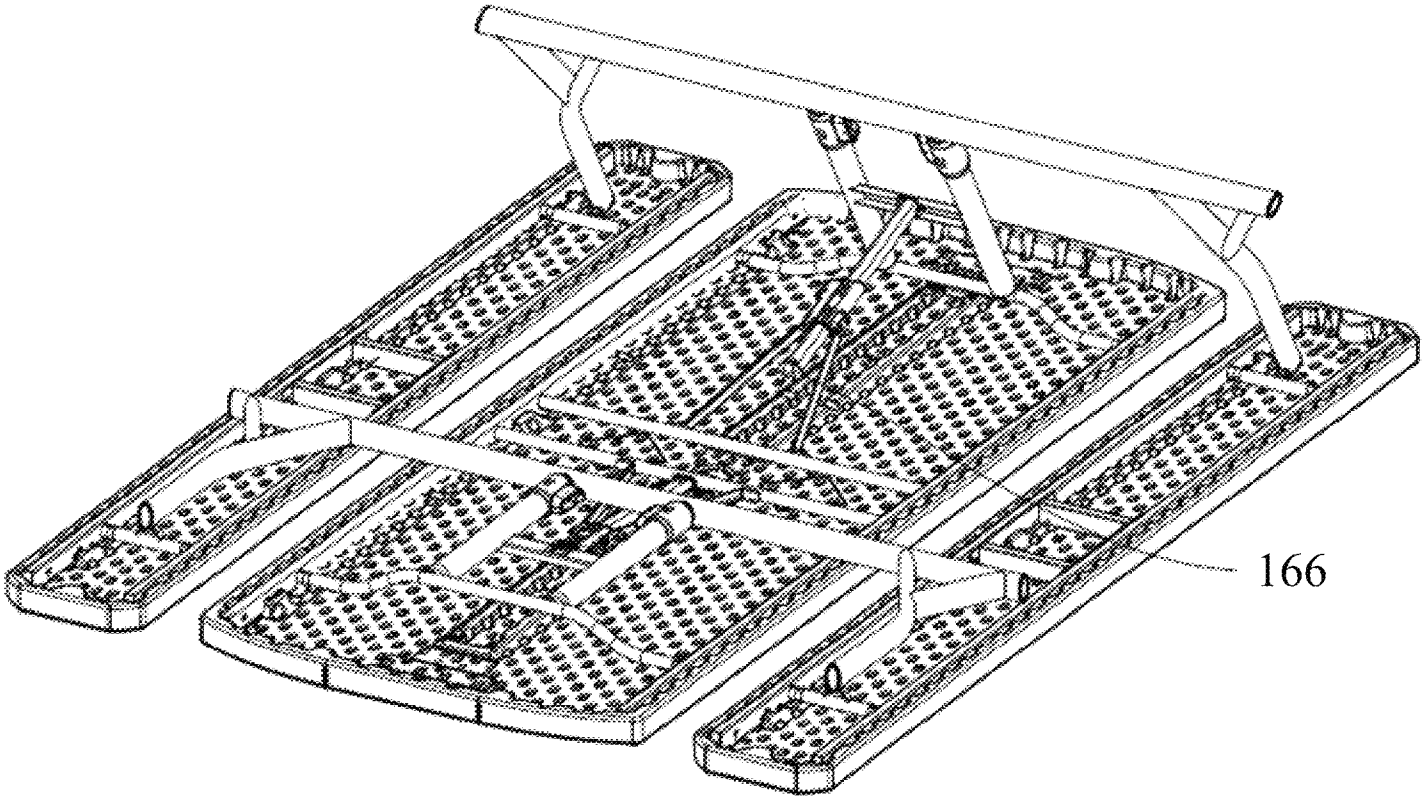
FIG. 5C is a bottom perspective view illustrating the foldable table of FIG. 4A in a third intermediate state in accordance with exemplary embodiments of the present disclosure.
Figure 5D:
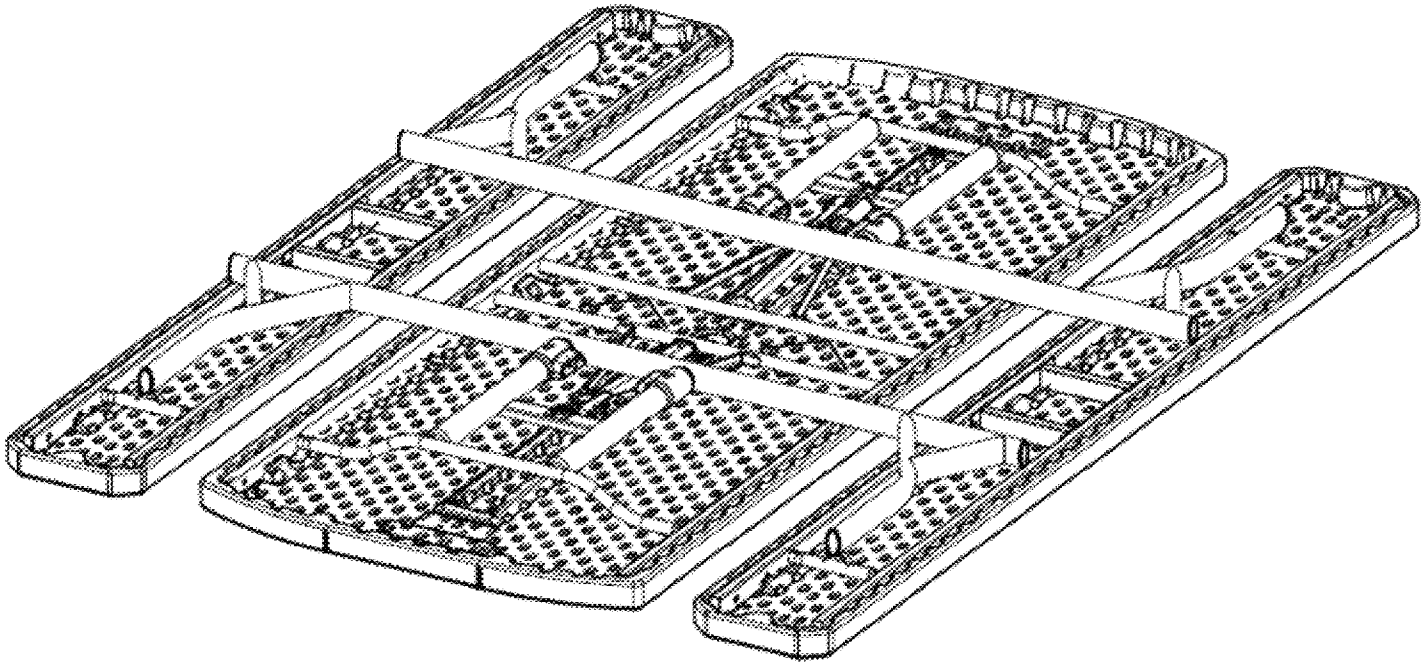
FIG. 5D is a bottom perspective view illustrating the foldable table of FIG. 4A in a folded state in accordance with exemplary embodiments of the present disclosure.

Referring to FIGS. 4A and 5A-5D, there is depicted an exemplary process to fold picnic table 200 in accordance with some embodiments of the present disclosure. First, the table leg assembly is adjusted to level the table and bench panels as illustrated in FIG. 5A. Then each leg assembly is rotated and folded onto the leveled table and bench panels as illustrated in FIGS. 5B and 5C. The folded picnic table is shown in FIG. 5D, which has a panel-like shape. As such, when folded, it is compact, and thus easy and convenient for storage and transportation. Reversing the process unfolds the picnic table.

Figure 6A:
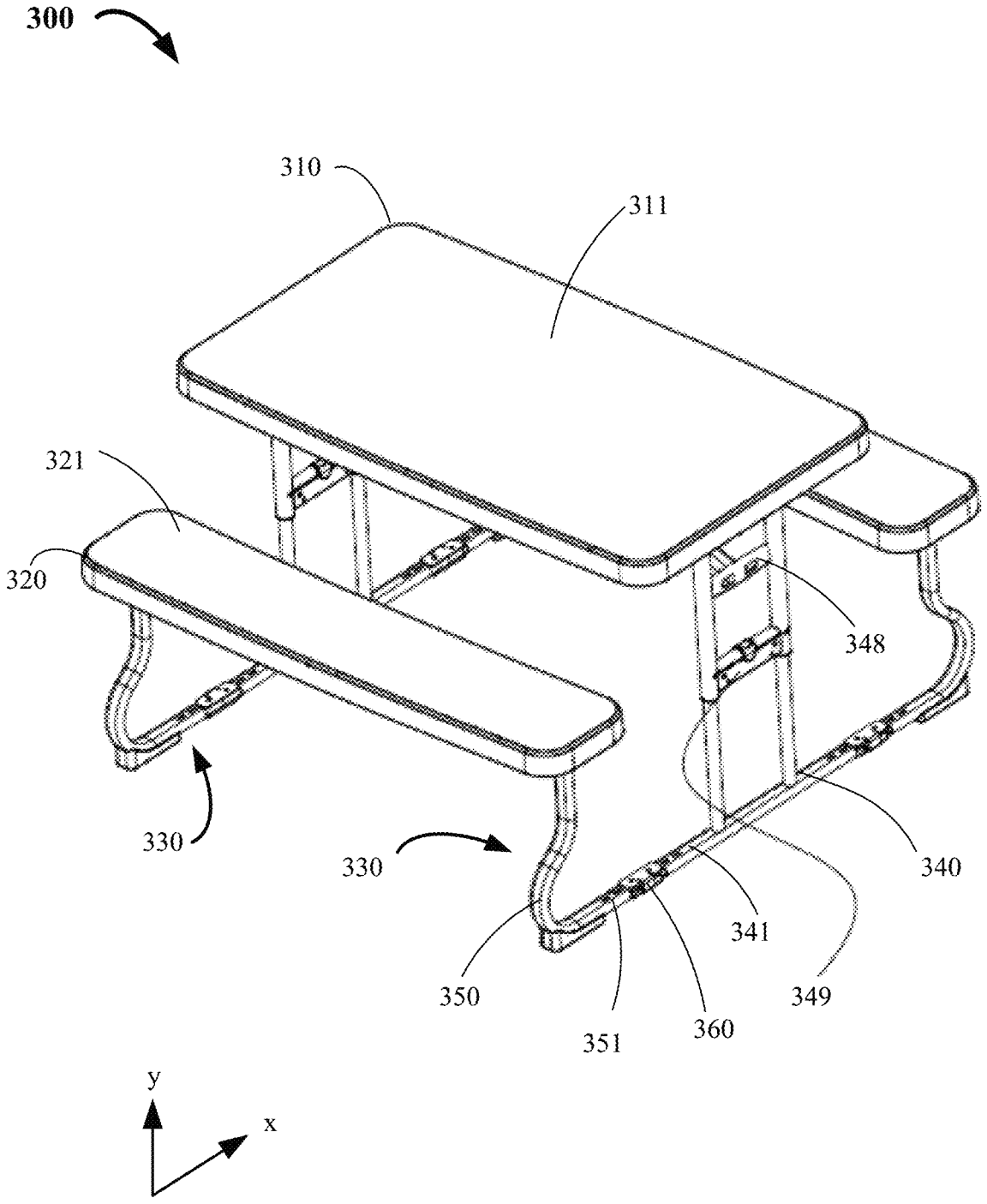
FIG. 6A is a top perspective view illustrating an exemplary foldable table in an unfolded state in accordance with exemplary embodiments of the present disclosure.
Figure 6B:
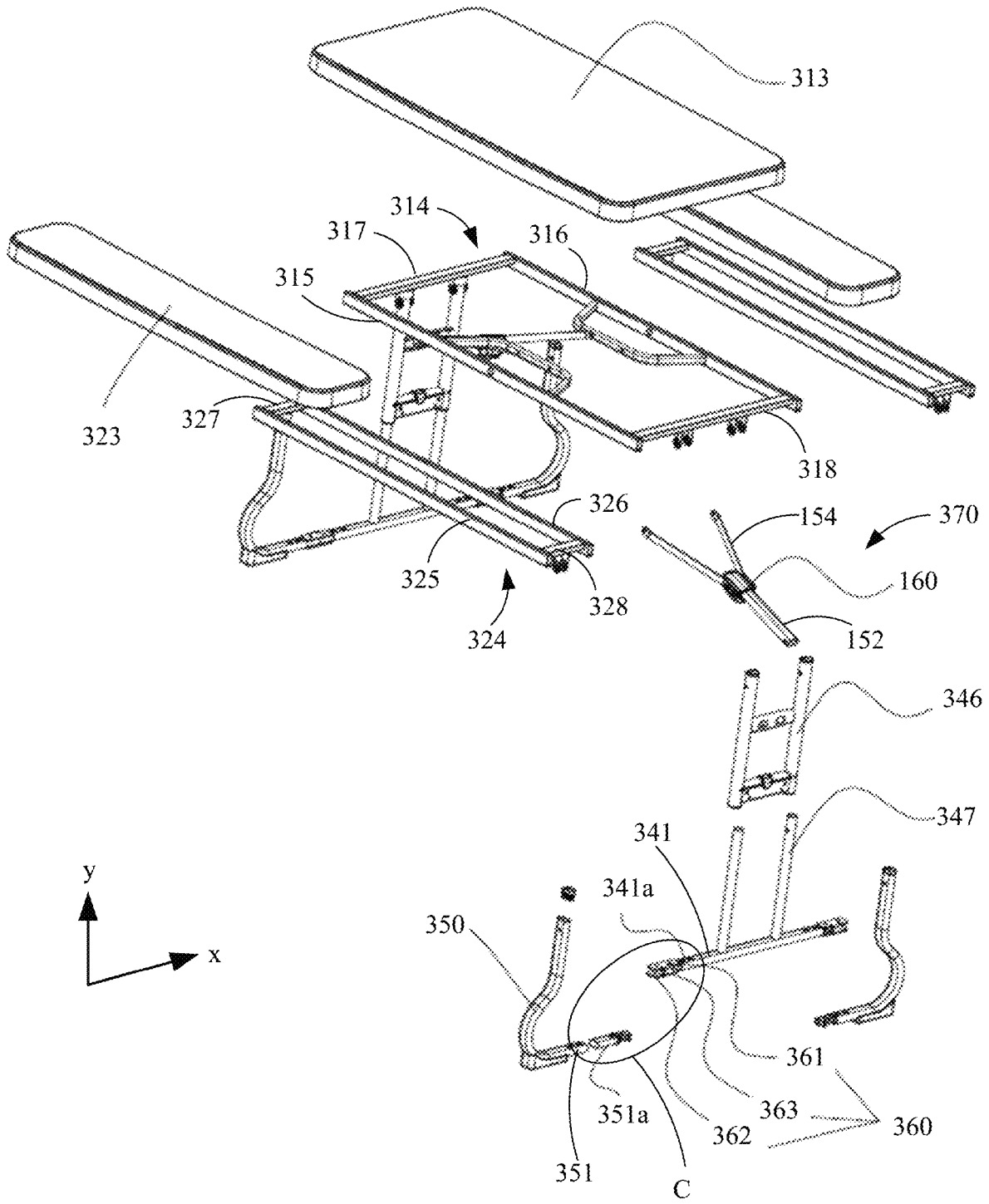
FIG. 6B is a partially disassembled perspective view illustrating the exemplary foldable table of FIG. 6A in accordance with exemplary embodiments of the present disclosure.
Figure 6C:
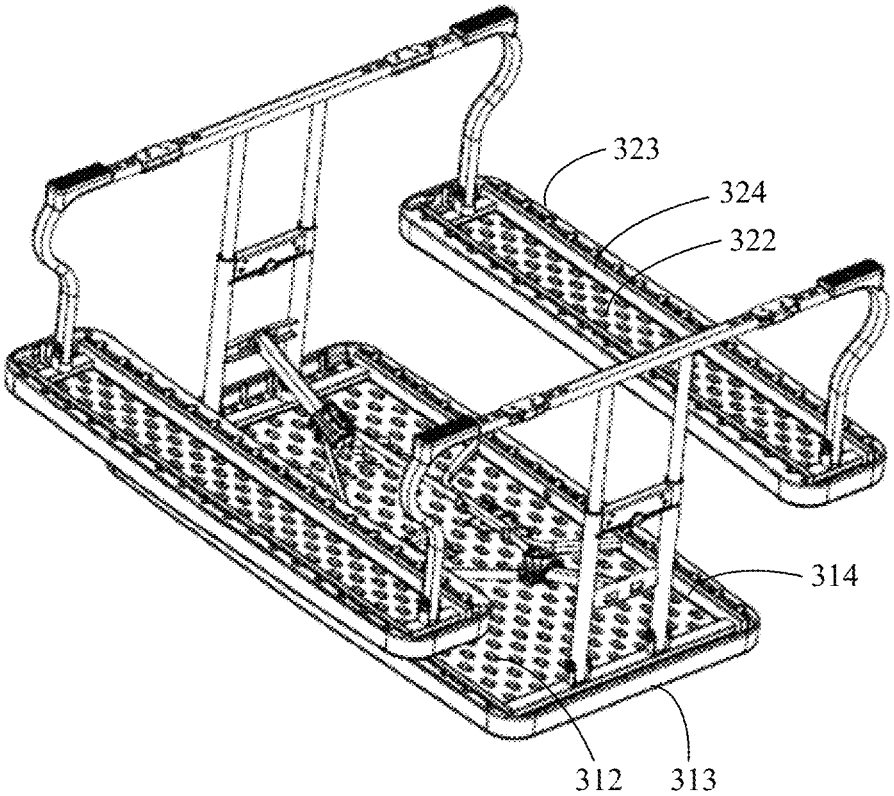
FIG. 6C is a bottom perspective view illustrating the exemplary foldable table of FIG. 6A.

Referring now to FIGS. 6A-6C, there is depicted exemplary picnic table 300 in accordance with some embodiments of the present disclosure. Picnic table 300 includes a tabletop such as tabletop 310, one or more benchtops such as benchtop 320, and one or more leg assemblies such as leg assembly 330 to support the tabletop and one or more benchtops. Leg assembly 330 includes a table leg assembly such as table leg assembly 340 to support the tabletop and, corresponding to each benchtop, a bench leg assembly such as bench leg assembly 350 to support the benchtop. By way of example, FIGS. 6A-6C illustrate two benchtops and two leg assemblies. The two benchtops can be the same as or different from each other. Similar, the two leg assemblies can be the same as or different from each other.

In some exemplary embodiments, tabletop 310 has an upper side and a lower side, and includes a table panel and a table frame. For instance, in an exemplary embodiment, tabletop 310 has upper side 311 and lower side 312, and includes table panel 313 and table frame 314. Table frame 314 is integrally formed or coupled with a lower side of table panel 313 for connecting table leg assembly 340 such that table leg assembly 340 is rotatable with respect to table panel 313 or tabletop 310. In some exemplary embodiments, table frame 314 includes a first table mounting member such as first table mounting member 315 and a second table mounting member such as second table mounting member 316. The first and second table mounting members are spaced apart generally in a first direction, e.g., the x-direction in FIG. 6B. In an exemplary embodiment, each of the first and second table mounting member includes a straight bar and a bended bar coupled or formed with the middle portion of the rail bar. Table frame 314 also includes one or more table leg linking members coupled with the first and second table mounting members. For instance, in an exemplary embodiment, table frame 314 includes first table leg linking member 317 and second table leg linking member 318. Each of the first and second table leg linking members has an end portion integrally formed or fixedly connected with the first table mounting member and another end portion integrally formed or fixedly connected with the second table mounting member.

Similar to tabletop 310, in some exemplary embodiments, benchtop 320 has an upper side and a lower side, and includes a bench panel and a bench frame. For instance, in an exemplary embodiment, benchtop 320 has upper side 321 and lower side 322, and includes bench panel 323 and bench frame 324. Bench frame 324 is integrally formed or coupled with a lower side of bench panel 323 for connecting bench leg assembly 340 such that bench leg assembly 340 is rotatable with respect to bench panel 323 or benchtop 320. In some exemplary embodiments, bench frame 324 includes a first bench mounting member such as first bench mounting member 325 and a second bench mounting member such as second bench mounting member 326. The first and second bench mounting members are spaced apart generally in the first direction. Bench frame 324 also includes one or more bench leg linking members coupled with the first and second bench mounting members. For instance, in an exemplary embodiment, bench frame 324 includes first bench leg linking member 327 and second bench leg linking member 328. Each of the first and second bench leg linking members has an end portion integrally formed or fixedly connected with the first bench mounting member and another end portion integrally formed or fixedly connected with the second bench mounting member.

In some exemplary embodiments, table leg assembly 340 is rotatable with respect to tabletop 310 around an axis parallel to a first direction (e.g., the x-direction in FIG. 6A or the lateral direction of the tabletop). For instance, in some exemplary embodiments, table leg assembly 340 includes one or more legs each having an upper end portion pivotally connected with first table leg linking member 317 or second table leg linking member 318 of table frame 314. In some exemplary embodiments, to further enhance the strength of the first or second table leg assembly, the first and second legs are connected with each other by one or more leg links such as first link 348 and second link 349. In some exemplary embodiments, table leg assembly 340 is configured to be an adjustable assembly or to include an adjustable assembly for adjusting the length of the table leg assembly and thus the height of the table panel. In an exemplary embodiment, one of the leg links (e.g., second link 349) is also configured to lock or unlock the adjustable assembly (e.g., to allow or prevent relative movement between upper portion 346 and lower portion 347 of the leg assembly). Examples of locking/unlocking mechanisms are disclosed in U.S. patent application Ser. No. 15/400,861, Ser. No. 15/931,925, Ser. No. 16/838,939, Ser. No. 16/838,944, Ser. No. 17/000,661, Ser. No. 17/003,047, Ser. No. 17/038,369 and Ser. No. 17/069,458, the disclosure of each application is incorporated herein for all purposes by reference in its entirety. As such, when unfolded, one can change the height of the table panel by adjusting collectively the lengths of table leg assemblies 340 of the leg assemblies.

Bench leg assembly 350 is rotatable with respect to benchtop 320 around an axis parallel to the first direction. For instance, in some exemplary embodiments, bench leg assembly 350 includes at least one leg having an upper end portion pivotally connected with first bench leg linking member 327 or second bench leg linking member 328 of bench frame 324. In some exemplary embodiments, the at least one leg is integrally formed or connected with a second supporting bar (e.g., second supporting bar 351 disclosed herein) of bench leg assembly 350. In an exemplary embodiment, the at least one leg is a portion of the second supporting bar of bench leg assembly 350.

In some exemplary embodiments, table leg assembly 340 and bench leg assembly 350 of leg assembly 330 are connected with each other and rotatable with respect to each other around an axis parallel to a second direction (e.g., the y-direction in FIG. 6A) that is different than the first direction. In an exemplary embodiment, the second direction is substantially perpendicular to the first direction. In some exemplary embodiments, leg assembly 330 includes one or more connectors such as connector 360, each for pivotally connecting one bench leg assembly 350 with table leg assembly 340 such that the bench leg assembly is rotatable with respect to the table leg assembly in the second direction. As such, picnic table 300 is foldable multiple times.

In some exemplary embodiments, picnic table 300 further includes one or more supporting assemblies to control the rotation (e.g., folding and unfolding) of the one or more leg assemblies, and/or to lock the one or more leg assemblies when the table is in use. In some exemplary embodiments, table leg assembly 340 includes a first supporting bar such as first supporting bar 341 and bench leg assembly 350 includes a second supporting bar such as second supporting bar 351. First supporting bar 341 and second supporting bar 351 are aligned with each other in the first direction when unfolded (e.g., when benchtop 320 is unfolded from tabletop 310, or when the picnic table is unfolded). Connector 360 pivotally connects the second supporting bar of the bench leg assembly with the first supporting bar of the table leg assembly such that the second supporting bar is rotatable with respect to the first supporting bar of the table leg assembly in the second direction.

Figure 7:
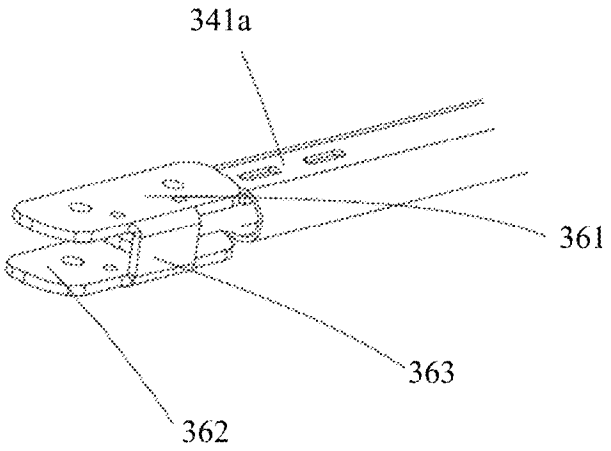
FIG. 7 is an enlarged view taken along oval C of FIG. 6B.
Figure 7:
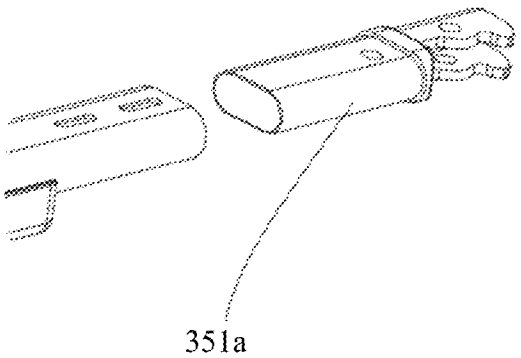
Figure 8A:
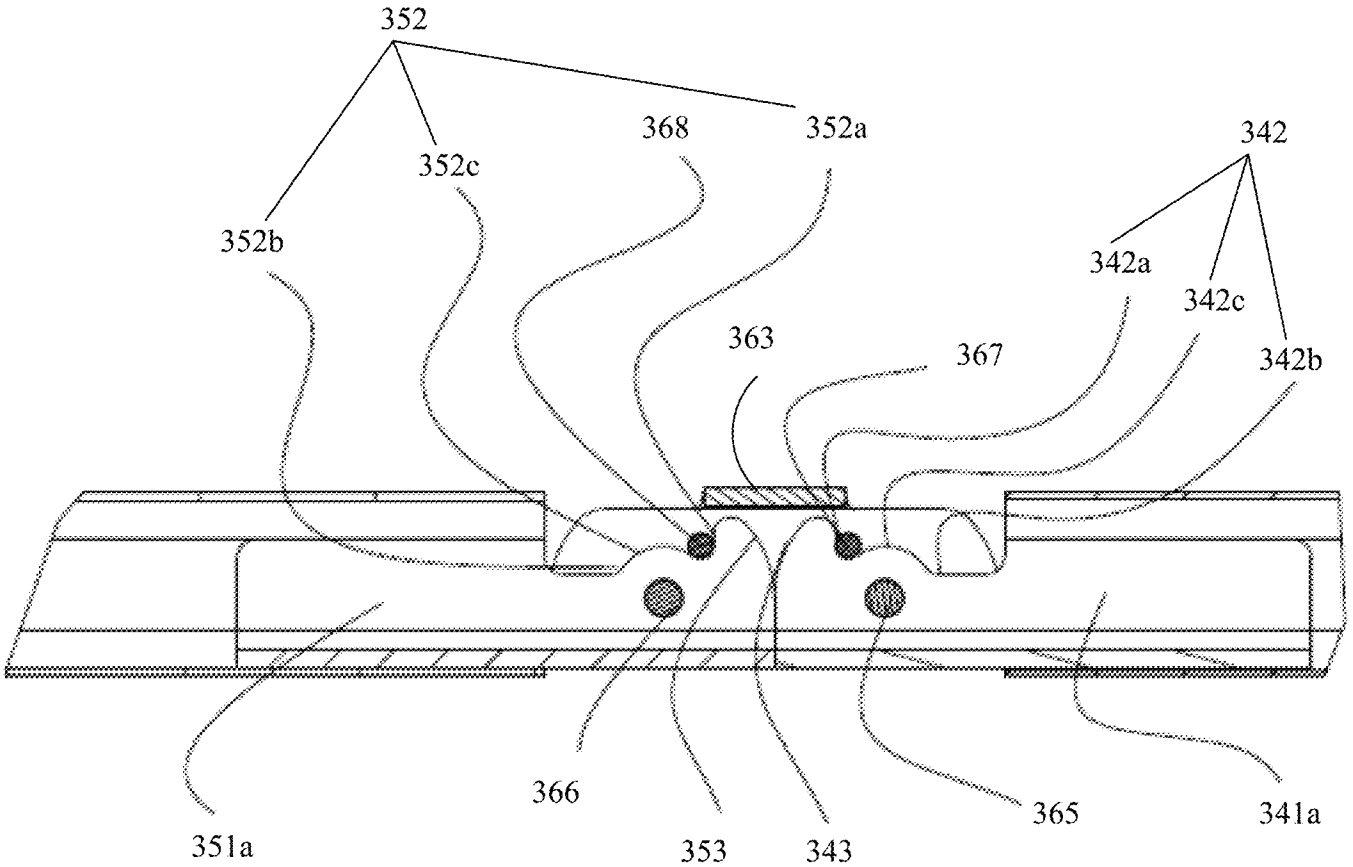
FIG. 8A is a schematic view illustrating a connection in an exemplary supporting assembly at oval D of FIG. 6F in accordance with exemplary embodiments of the present disclosure.
Figure 8B:
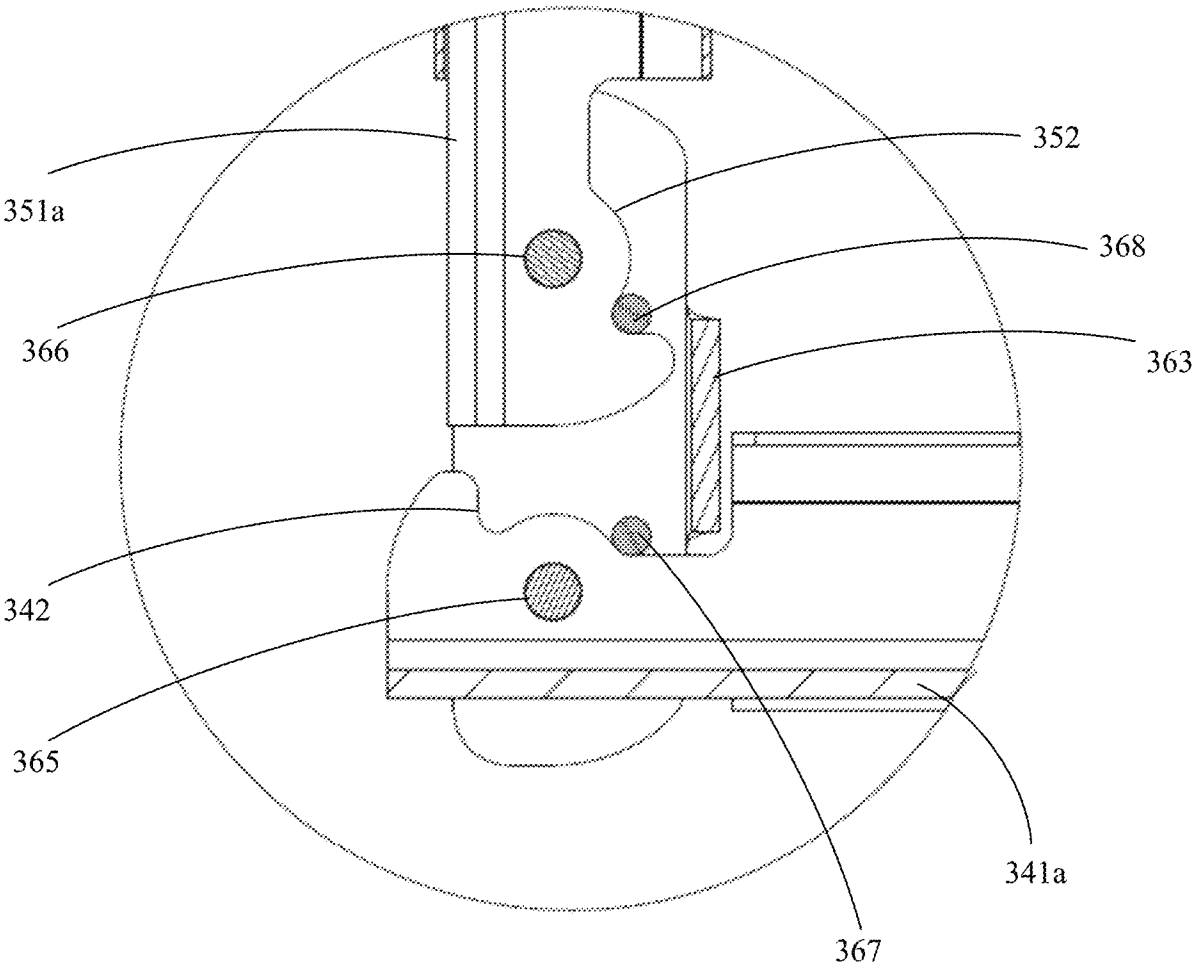
FIG. 8B is a schematic view illustrating a connection in an exemplary supporting assembly at oval E of FIG. 6G in accordance with exemplary embodiments of the present disclosure.
Figure 8C:
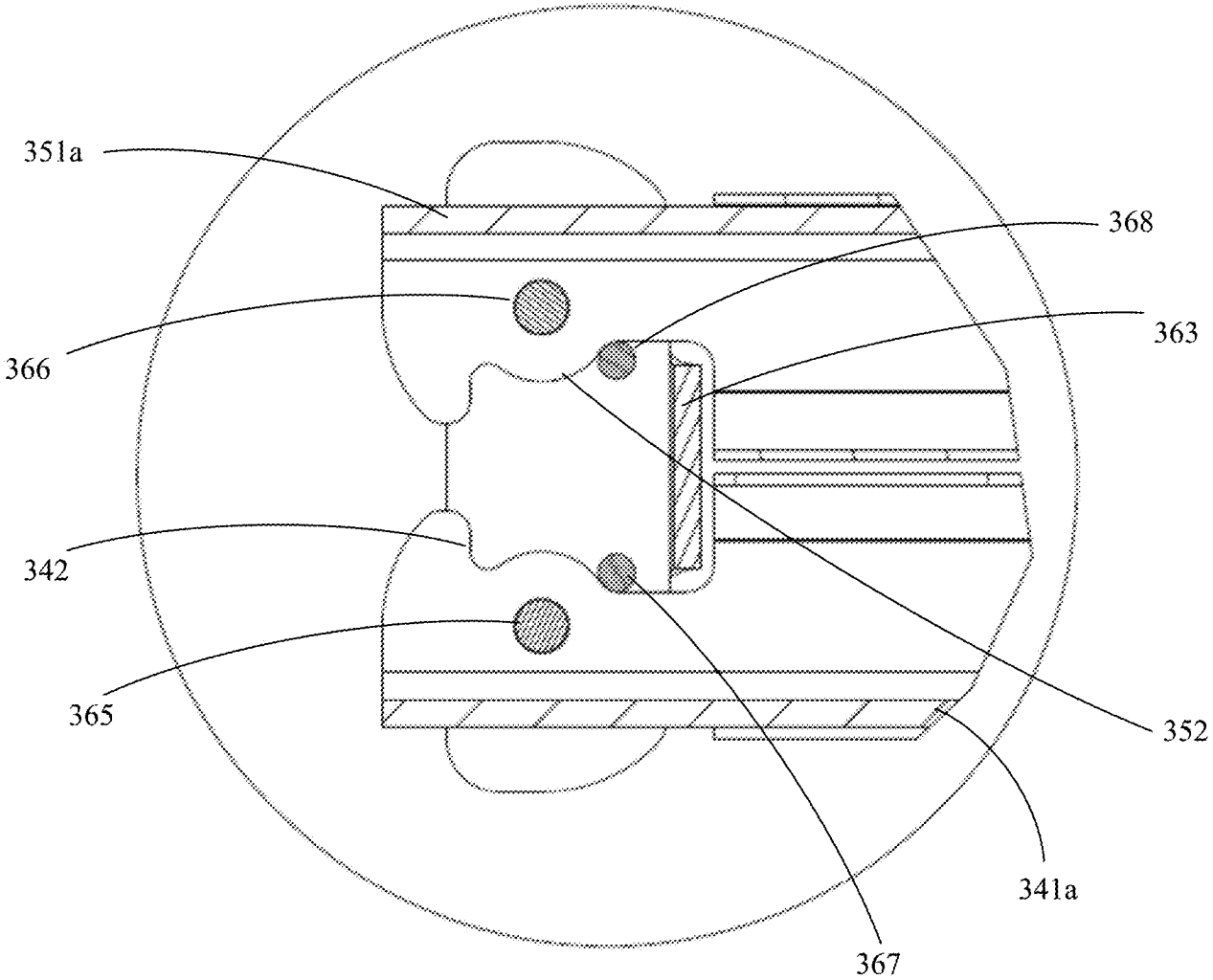
FIG. 8C is a schematic view illustrating a connection in an exemplary supporting assembly at oval F of FIG. 6H in accordance with exemplary embodiments of the present disclosure.

Referring to FIGS. 7 and 8A-8C, there is depicted connector 360 and the use of the connector to connect the second supporting bar of the bench leg assembly with the first supporting bar of the table leg assembly in accordance with some exemplary embodiments of the present disclosure. Of these figures, FIG. 7 is an enlarged perspective view taken along oval C of FIG. 6B, illustrating the connection at an unfolded state (e.g., the first and second supporting bars are aligned with each other), FIG. 8A illustrates schematically the connection at the unfolded state, FIG. 8B illustrates schematically the connection at an intermediate state, and FIG. 8C illustrates schematically the connection at a folded state.

In some exemplary embodiments, connector 360 includes at least one connecting piece, a first fastener pivotally connecting an end portion of the first supporting bar with the at least one connecting piece, and a second fastener pivotally connecting an end portion of the second supporting bar with the at least one connecting piece. For instance, in the illustrated embodiment, connector 360 including first connecting piece 361, second connecting piece 362, first fastener 365 and second fastener 366. In an exemplary embodiment, the first and second connecting pieces are disposed opposing to each other to form a channel to receive the end portion of the first supporting bar and the end portion of the second supporting bar. In some exemplary embodiments, connector 360 further includes at least one third connecting piece fixedly connected or integrally formed with the first and second connecting pieces. For instance, FIG. 7 illustrates one third connecting piece 363 having an end fixedly connected or integrally formed with first connecting piece 361 and another end fixedly connected or integrally formed with second connecting piece 362.

First fastener 365 pivotally connects end portion 341*a* of first supporting bar 341 of the table leg assembly with the first and second connecting pieces. Second fastener 366 pivotally connects end portion 351*a* of second supporting bar 351 of the bench leg assembly with the first and second connecting pieces. First supporting bar 341 of the table leg assembly or second supporting bar 351 of the bench leg assembly can be a single unitary piece or made of multiple bar segments. In an exemplary embodiment, the end portion of first supporting bar 341 of the table leg assembly or second supporting bar 351 of the bench leg assembly includes a coupler connected or formed with the first or second supporting bar. The end portion 341*a* of first supporting bar 341 and the end portion 351*a* of second supporting bar 351 can be disposed generally symmetric or asymmetric with respect to each other.

In some exemplary embodiments, to assist folding and unfolding of first supporting bar 341 of the table leg assembly (and thus the table panel) or second supporting bar 351 of the bench leg assembly (and thus the bench panel), the end portion of the first or second supporting bar includes a curved side surface and the connector includes a pin operably coupled with the curved side surface to guide the rotation of the first or second supporting bar. For instance, in an exemplary embodiment, end portion 341*a* of the first supporting bar includes a first curved side surface such as first curved side surface 342, and end portion 351*a* of the second supporting bar includes a second curved side surface such as second curved side surface 352. Connector 360 includes a first pin such as first pin 367 and a second pin such as second pin 368. First pin 367 and second pin 368 are disposed at (e.g., fixed coupled or integrally formed with) the first and/or second connecting pieces of connector 360. First pin 367 is operably coupled with first curved side surface 342 to help guide rotation of the first supporting bar with respect to the first and/or second connecting pieces of connector 360. Second pin 368 is operably coupled with second curved side surface 352 to help guide rotation of the second supporting bar with respect to the at least one connecting piece.

In some exemplary embodiments, to help stabilize the table and/or bench leg assemblies, the first curved side surface of the first supporting bar or the second curved side surface of the second supporting bar includes one or more indentations. For instance, in some exemplary embodiments, first curved side surface 342 includes a first indentation such as first indentation 342*a* and a second indentation such as second indentation 342*b*. First indentation 342*a* is configured to accommodate crosswise at least a portion of first pin 367 when the picnic table is unfolded and second indentation 342*b* is configured to accommodate crosswise at least a portion of first pin 367 when the picnic table is folded. Similarly, in some exemplary embodiments, second curved side surface 352 includes a first indentation such as first indentation 352*a* and a second indentation such as second indentation 352*b*. First indentation 352*a* is configured to accommodate crosswise at least a portion of second pin 368 when the picnic table is unfolded and second indentation 352*b* is configured to accommodate crosswise at least a portion of second pin 368 when the picnic table is folded.

In some exemplary embodiments, a convex segment such as convex segment 342*c* is formed between first indentation 342*a* and second indentation 342*b* to further assist rotation of first supporting bar 341 of the table leg assembly. In an exemplary embodiment, convex segment 342*c* has a circular profile. Similar, in some exemplary embodiments, a convex segment such as convex segment 352*c* is formed between first indentation 352*a* and second indentation 352*b* to further assist rotation of second supporting bar 351 of the bench leg assembly. In an exemplary embodiment, convex segment 352*c* has a circular profile.

While the first and second pins in the illustrated embodiments are substantially the same as and symmetric to each other, it should be noted that this is a non-limiting example. The first and second pins can be configured in any suitable shapes, sizes and disposed at any suitable positions. Similarly, while the first and second curved side surfaces in the illustrated embodiments are substantially the same as and symmetric to each other, it should be noted that this is a non-limiting example. The first and second curved side surfaces can be of any suitable configurations (e.g., shapes, sizes) and disposed at any suitable positions.

In some exemplary embodiments, to further assist folding and unfolding of first supporting bar 341 of the table support (and thus the table panel) or second supporting bar 351 of the bench support (and thus the bench panel), the end portion of the first or second supporting bar includes an end surface that is at least partially curved. For instance, in an exemplary embodiment, end portion 341*a* of the first supporting bar includes a first end surface such as first end surface 343, and end portion 351*a* of the second supporting bar includes a second end surface such as second end surface 353. Each of the first and second end surfaces includes a substantially flat portion and a curved portion. The flat portions of the first and second end surfaces abut each other when unfolded and thus help to stabilize the unfolded bench and table supports. The curved portions of the first and second end surfaces make it easy to rotate the first and second supporting bars with respect to each other.

Referring back to FIGS. 6A and 6B, in some exemplary embodiments, picnic table 300 further includes one or more supporting assemblies to control the rotation (e.g., folding and unfolding) of the one or more leg assemblies, and/or to lock the one or more leg assemblies when the table is in use. The one or more supporting assemblies can be the same as or different from each other. By way of example, FIGS. 6A and 6B illustrate two supporting assemblies 370 each pivotally connected with the table frame and a corresponding table leg assembly. In some exemplary embodiments, supporting assembly 370 includes first supporting member 152 and second supporting member 154 slidably and rotatably coupled with each other by controller 160. First supporting member 152 is pivotally coupled with table leg assembly 340, for instance, coupled with first leg link 348 of table leg assembly 340. In an exemplary embodiment, second supporting member 154 includes two supporting bars, one on each side of the controller. One supporting bar has an end portion pivotally connected with controller 160 and the other end portion pivotally connected with first table mounting member 315. The other supporting bar has an end portion pivotally connected with controller 160 and the other end portion pivotally connected with second table mounting member 316. As such, supporting assembly 370 controls the rotation of the leg assembly. When the table is in use, supporting assembly 370 holds the leg assembly in its use position and prevents the leg assembly from rotating with respect to the tabletop. As such, the table is very stable and safe to use.

Figure 6D:
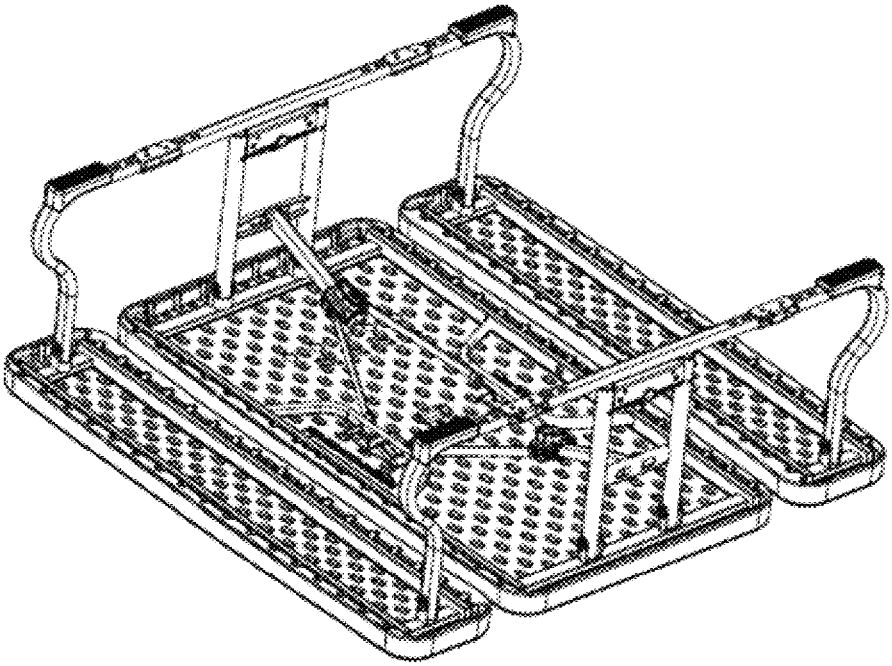
FIG. 6D is a bottom perspective view illustrating the exemplary foldable table of FIG. 6A with the table panel at a different height in accordance with exemplary embodiments of the present disclosure.
Figure 6E:
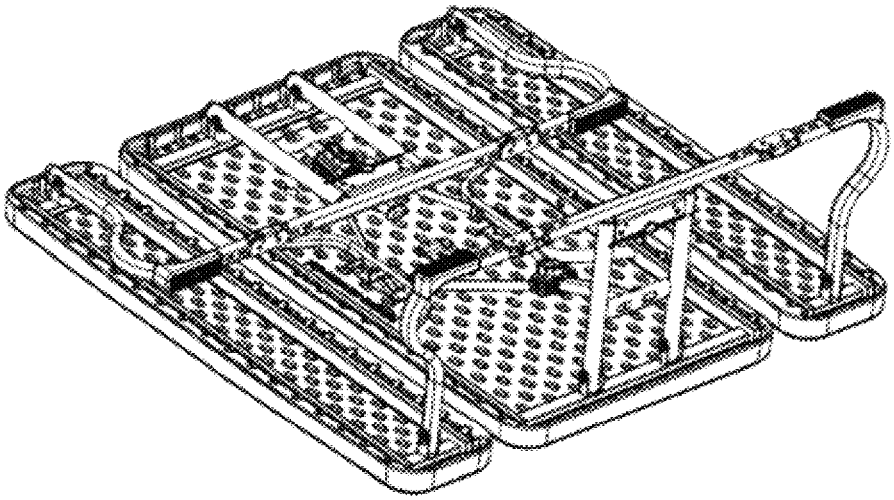
FIG. 6E is a bottom perspective view illustrating the exemplary foldable table of FIG. 6A in a first intermediate state in accordance with exemplary embodiments of the present disclosure.
Figure 6F:
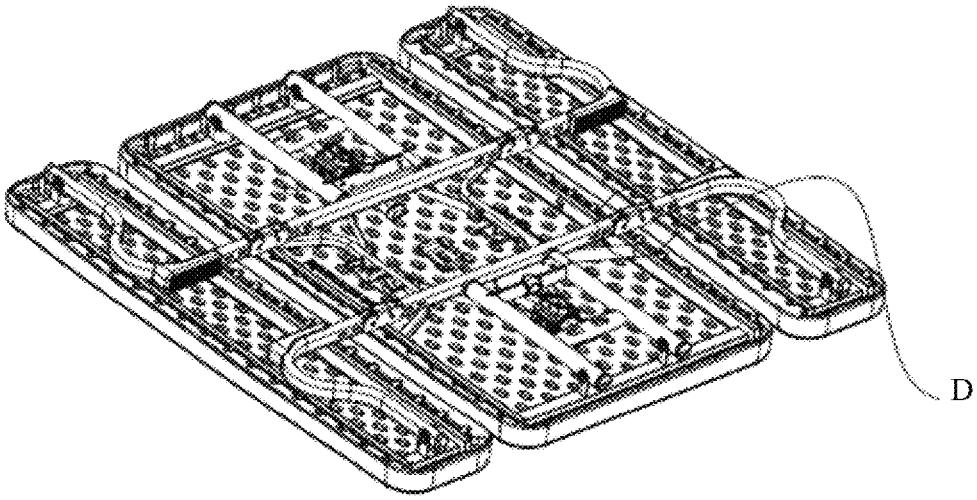
FIG. 6F is a bottom perspective view illustrating the exemplary foldable table of FIG. 6A in a second intermediate state in accordance with exemplary embodiments of the present disclosure.
Figure 6G:
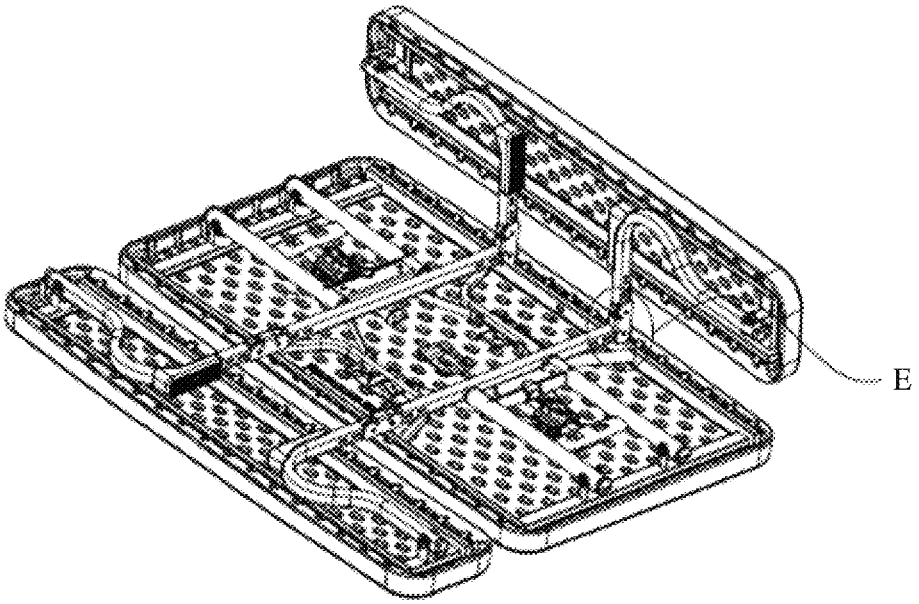
FIG. 6G is a bottom perspective view illustrating the exemplary foldable table of FIG. 6A in a third intermediate state in accordance with exemplary embodiments of the present disclosure.
Figure 6H:
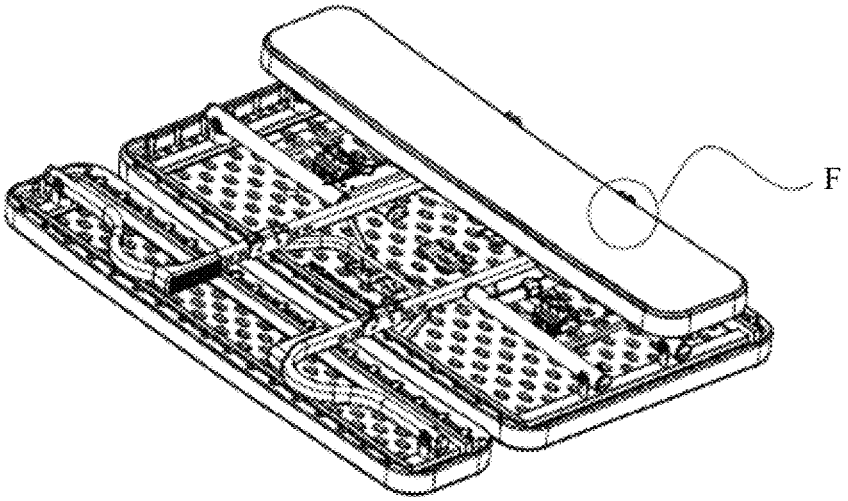
FIG. 6H is a bottom perspective view illustrating the exemplary foldable table of FIG. 6A in a fourth intermediate state in accordance with exemplary embodiments of the present disclosure.
Figure 6I:
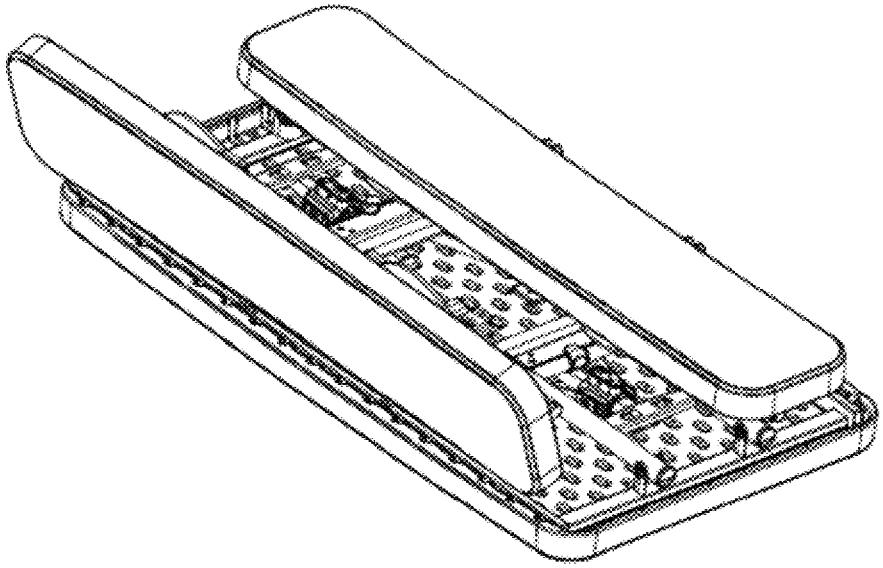
FIG. 6I is a bottom perspective view illustrating the exemplary foldable table of FIG. 6A in a fifth intermediate state in accordance with exemplary embodiments of the present disclosure.
Figure 6J:
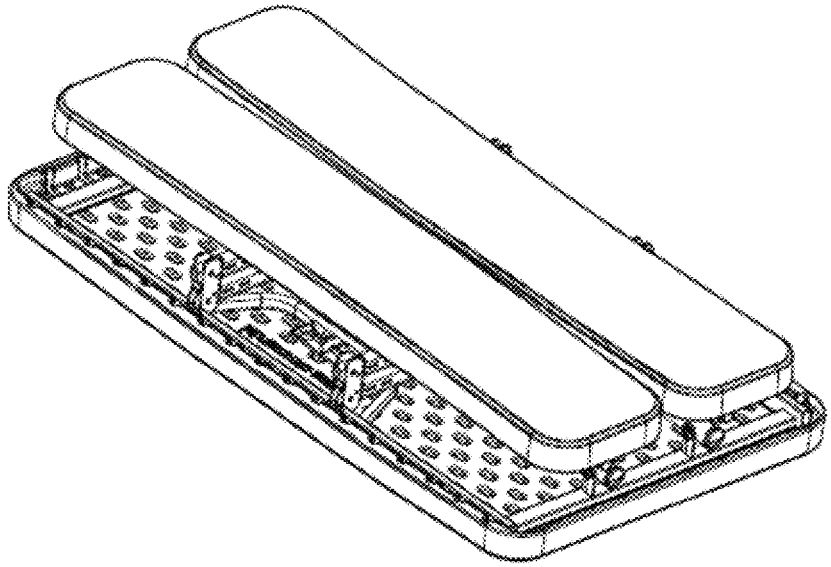
FIG. 6J is a bottom perspective view illustrating the exemplary foldable table of FIG. 6A in a folded state in accordance with exemplary embodiments of the present disclosure.

Referring to FIGS. 6C-6J, there is depicted an exemplary process for folding and unfolding picnic table 300. First, the table leg assembly is adjusted to level the table and bench panels as illustrated in FIG. 6D. Then each leg assembly is rotated and folded onto the leveled table and bench panels as illustrated in FIGS. 6E and 6F. After that, each bench panel is rotated and folded onto the table panel as illustrated in FIGS. 6G-6I. The folded picnic table is illustrated in FIG. 6J. The leg assemblies (at least a portion of them) are sandwiched between the table and bench panels. While rotation illustrated in FIGS. 6G-6I results in the lower sides of the table and bench panels facing each other (e.g., back-to-back), it should be noted that a similar structure can be constructed such that when folded the upper sides of the table and bench panels face each other (e.g., face-to-face). In either case, the picnic table is folded into a generally layered block-like structure. As such, when folded, it is compact, and thus easy and convenient for storage and transportation. Reversing the process unfolds the picnic table.

The components disclosed herein are combinable in any useful number and combination. For example, table leg assembly 240 can replace first table leg assembly 130*a* and second table leg assembly 130*b* of table 100 to make table 100 adjustable in height. As another example, supporting assembly 370 can replace supporting assembly 260.

The supporting assemblies, supporting frames and tables of the present disclosure have several advantages. For instance, the supporting assemblies and other additional/optional structures help dispersing localized stresses and thus prolonging the lifespan of the tables. Moreover, the supporting assemblies and other additional/optional structures help stabilizing and supporting the leg assemblies when unfolded and thus enhancing the stability of the tables when in use. Further, the supporting assemblies and other additional/optional structures make folding and unfolding of the tables smooth and fast. In addition, the tables disclosed herein are easy to fold and unfold, and compact when folded.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A table comprising:

a tabletop having an upper side and a lower side;

first and second table leg assemblies, each pivotally coupled with the tabletop and rotatable with respect to the tabletop between a use position and a storage position;

a first supporting assembly pivotally coupled with the tabletop and first table leg assembly, and configured to control rotation of the first table leg assembly with respect to the tabletop; and a second supporting assembly pivotally coupled with the tabletop and second table leg assembly, and configured to control rotation of the second table leg assembly with respect to the tabletop, wherein each of the first and second supporting assemblies comprises:

a first supporting member pivotally coupled with a corresponding table leg assembly in the first and second table leg assemblies;

a controller coupled with the first supporting member and moveable along a length direction of the first supporting member; and a second supporting member having a first end portion pivotally coupled with the tabletop, and a second end portion coupled with the controller, thereby facilitating the second end portion of the second supporting member to move together with the controller along the length direction of the first supporting member;

wherein movement of the second end portion of the second supporting member together with the controller along the length direction of the first supporting member of a respective supporting assembly in the first and second supporting assemblies allows a corresponding table leg assembly in the first and second table leg assemblies to rotate with respect to the tabletop between the use and storage positions.

2. The table of claim 1, wherein the tabletop comprises:

a table panel; and a table frame comprising first and second table mounting members disposed at a lower side of the table panel and spaced apart in a first direction.

3. The table of claim 2, wherein the table panel comprises first and second panel segments; and each of the first and second table mounting members comprises first and second table mounting segments pivotally coupled with each other at adjacent end portions thereof;

the first table mounting segments of the first and second table mounting members are disposed at the first panel segment;

the first table leg assembly and first supporting assembly are coupled with the first table mounting segments of the first and second table mounting members;

the second table mounting segments of the first and second table mounting members are disposed at the second panel segment;

the second table leg assembly and second supporting assembly are coupled with the second table mounting segments of the first and second table mounting members; and when folded, the lower sides of the first and panel segments face each other with the first and second table leg assemblies and the first and second supporting assemblies in between.

4. The table of claim 2, wherein the corresponding table leg assembly comprises:

a table leg linking member having a first end portion pivotally coupled with the first table mounting member and a second end portion pivotally coupled with the second table mounting member;

first and second legs spaced apart in the first direction, each having an upper end portion fixedly connected with the table leg linking member; and one or more leg links, each disposed between the first and second legs and coupled with the first and second legs, wherein the first supporting member of the respective supporting assembly is pivotally connected with a leg link in the one or more leg links of the corresponding table leg assembly.

5. The table of claim 2, wherein:

the table frame comprises a table leg linking member having a first end portion fixedly coupled with the first table mounting member and a second end portion fixedly coupled with the second table mounting member; and the corresponding table leg assembly comprises:

first and second legs spaced apart in the first direction, each having an upper end portion pivotally connected with the table leg linking member; and one or more leg links, each disposed between the first and second legs and coupled with the first and second legs, wherein the first supporting member of the respective supporting assembly is pivotally connected with a leg link in the one or more leg links of the corresponding table leg assembly.

6. The table of claim 2, wherein each of the first and second supporting assemblies comprises a third supporting member having a first end portion pivotally coupled with the first table mounting member and a second end portion pivotally coupled with the second table mounting member, wherein one of the first and second supporting members is pivotally coupled with the corresponding table leg assembly and the other of the first and second supporting members is fixedly coupled with the third supporting member.

7. The table of claim 2, wherein:

the first supporting member is pivotally coupled with the corresponding table leg assembly; and the second supporting member comprises:

a first bar having a first end portion slidably and rotatably coupled with the first supporting member and a second end portion pivotally coupled with the first table mounting member of the table frame; and a second bar having a first end portion slidably and rotatably coupled with the first supporting member and a second end portion pivotally coupled with the second table mounting member of the table frame.

8. The table of claim 1, wherein of each of the first and second supporting assemblies, the second supporting member comprises a first bar and a second bar, each having a first end portion pivotally coupled with the tabletop and a second end portion coupled with the controller.

9. The table of claim 1, wherein the controller comprises a body configured to sleeve on the first supporting member.

10. The table of claim 1, wherein the controller comprises a pin configured to be selectively inserted into a hole formed at the first supporting member, thereby selectively restricting the movement of the controller along the length direction of the first supporting member.

11. The table of claim 1, wherein the first supporting member comprises a stopper to prevent complete disengagement of the controller from the first supporting member.

12. The table of claim 1, further comprising:

one or more benchtops, each having an upper side and a lower side;

one or more first bench leg assemblies adjacent to the first table leg assembly; and one or more second bench leg assemblies adjacent to the second table leg assembly, wherein each respective bench leg assembly in the first and second bench leg assemblies is pivotally coupled with a corresponding benchtop in the one or more benchtops and rotatable with respect to the corresponding benchtop between a use position and a storage position.

13. The table of claim 12, wherein:

the one or more first bench leg assemblies are coupled with the first table leg assembly to synchronize rotation of the one or more first bench leg assemblies with respect to the one or more benchtops and rotation of the first table leg assembly with respect to the tabletop; and the one or more second bench leg assemblies are coupled with the second table leg assembly to synchronize rotation of the one or more second bench leg assemblies with respect to the one or more benchtops and rotation of the second table leg assembly with respect to the tabletop.

14. The table of claim 12, wherein when unfolded each of the first and second table leg assemblies is adjustable in height.

15. The table of claim 12, wherein:

each of the one or more benchtops comprises:

a bench panel; and a bench frame comprising first and second bench mounting members spaced apart in a first direction; and each respective bench leg assembly comprises a bench leg linking member having a first end portion pivotally coupled to the first bench mounting member and a second end portion pivotally coupled to the second bench mounting member.

16. The table of claim 15, wherein each of the one or more benchtops further comprises a strengthening member disposed between the first and second bench mounting members.

17. A table comprising:

a table panel;

a table frame comprising first and second table mounting members disposed at a lower side of the table panel and spaced apart in a first direction;

first and second table leg assemblies, each pivotally coupled with the table frame and rotatable with respect to the table panel between a use position and a storage position; and first and second supporting assemblies, each comprising:

a first supporting member;

a controller coupled with the first supporting member and movable along a length direction of the first supporting member;

a second supporting member coupled with the controller, thereby facilitating the second supporting member to move together with the controller along the length direction of the first supporting member; and a third supporting member having a first end portion pivotally coupled with the first table mounting member and a second end portion pivotally coupled with the second table mounting member, wherein one of the first and second supporting members is fixedly coupled with the third supporting member and the other of the first and second supporting members is pivotally coupled with a corresponding table leg assembly in the first and second table leg assemblies such that movement of the second supporting member together with the controller along the length direction of the first supporting member allows the corresponding table leg assembly to rotate with respect to the table panel between the use and storage positions.

18. The table of claim 17, wherein the corresponding table leg assembly comprises:

a table leg linking member having a first end portion pivotally coupled with the first table mounting member and a second end portion pivotally coupled with the second table mounting member;

first and second legs spaced apart in the first direction, each having an upper end portion fixedly connected with the table leg linking member; and one or more leg links, each disposed between the first and second legs and coupled with the first and second legs, wherein the first supporting member of the respective supporting assembly is pivotally connected with a leg link in the one or more leg links of the corresponding table leg assembly.

19. The table of claim 17, wherein:

the table frame comprises a table leg linking member having a first end portion fixedly coupled with the first table mounting member and a second end portion fixedly coupled with the second table mounting member; and the corresponding table leg assembly comprises:

first and second legs spaced apart in the first direction, each having an upper end portion pivotally connected with the table leg linking member; and one or more leg links, each disposed between the first and second legs and coupled with the first and second legs, wherein the first supporting member of the respective supporting assembly is pivotally connected with a leg link in the one or more leg links of the corresponding table leg assembly.

20. The table of claim 17, wherein the controller comprises:

a body configured to sleeve on the first supporting member; and a pin configured to be selectively inserted into a hole formed at the first supporting member, thereby selectively restricting the movement of the controller along the length direction of the first supporting member.

* * * * *